US007541532B2

(12) United States Patent
Osuga et al.

(10) Patent No.: US 7,541,532 B2
(45) Date of Patent: Jun. 2, 2009

(54) KEY STRUCTURE AND KEYBOARD APPARATUS

(75) Inventors: Ichiro Osuga, Hamamatsu (JP); Kenichi Nishida, Hamamatsu (JP); Yoichirou Shimomuku, Hamakita (JP)

(73) Assignee: Yamaha Corporation, Hamamatsu-Shi (JP)

( * ) Notice: Subject to any disclaimer, the term of this patent is extended or adjusted under 35 U.S.C. 154(b) by 109 days.

(21) Appl. No.: 11/542,915

(22) Filed: Oct. 3, 2006

(65) Prior Publication Data

US 2007/0022864 A1 Feb. 1, 2007

Related U.S. Application Data

(62) Division of application No. 10/940,903, filed on Sep. 13, 2004, now Pat. No. 7,176,370.

(30) Foreign Application Priority Data

Sep. 12, 2003 (JP) ..... 2003-320964
Jul. 22, 2004 (JP) ..... 2004-214199

(51) Int. Cl.
*G10C 3/12* (2006.01)

(52) U.S. Cl. ..... 84/436; 84/423 R; 84/433; 84/434; 84/441; 84/719; 84/744

(58) Field of Classification Search ..... 84/423 R, 84/430, 433, 441, 719, 744, 434, 436
See application file for complete search history.

(56) References Cited

U.S. PATENT DOCUMENTS 366,615 A * 7/1887 Becker ..... 84/436
669,729 A * 3/1901 Hedgeland ..... 84/436
821,533 A * 5/1906 Pekat ..... 84/434

(Continued)

FOREIGN PATENT DOCUMENTS

JP H08-006557 1/1996

(Continued)

OTHER PUBLICATIONS

Japanese Office Action, mailed Mar. 9, 2009, for JP2004-214199.

*Primary Examiner*—Jeffrey Donels
*Assistant Examiner*—Robert W Horn
(74) *Attorney, Agent, or Firm*—Morrison & Foerster LLP

(57) ABSTRACT

A key structure which is capable of giving a woody appearance to the key, and increasing the freedom of mounting at least one functional part formed as a separate part from the key structure, while maintaining excellent machinability. An upper plate has an increased width part corresponding to an end of a white key toward a player. In the key structure, a wood part is secured to the lower surface of at least the increased width part of the upper plate, and has an increased width part having substantially the same width as the increased width part of the upper plate. The key structure is mountable in a keyboard apparatus, for functioning as a white key pivotally moved by key-depressing operation. A recess is formed in a part of the wood part including the increased width part, which opens downward and has a width (W0) not less than 50% and not more than 80% of the width (B0) of the increased width part of the wood part.

9 Claims, 10 Drawing Sheets

U.S. PATENT DOCUMENTS

| | | | | | |
|---|---|---|---|---|---|
| 2,482,619 | A | * | 9/1949 | Howe | 84/223 |
| 3,026,760 | A | * | 3/1962 | Fauser | 84/423 R |
| 3,038,363 | A | * | 6/1962 | Miessner | 84/733 |
| 3,120,146 | A | * | 2/1964 | Stiles | 84/433 |
| 3,248,992 | A | * | 5/1966 | Underwood, Jr. et al. | 84/436 |
| 3,254,554 | A | * | 6/1966 | Nordquist | 84/434 |
| 3,736,831 | A | * | 6/1973 | May et al. | 84/434 |
| 3,738,216 | A | | 6/1973 | Slaats et al. | |
| 3,747,465 | A | * | 7/1973 | Schutze | 84/436 |
| 4,476,769 | A | | 10/1984 | Kumano | |
| 4,512,234 | A | | 4/1985 | Kumano | |
| 4,840,104 | A | | 6/1989 | Ishida et al. | |
| 4,892,024 | A | | 1/1990 | Watanabe | |
| 5,036,743 | A | | 8/1991 | Yamaguchi et al. | |
| 5,079,985 | A | * | 1/1992 | Yamaguchi et al. | 84/719 |
| 5,406,875 | A | * | 4/1995 | Tamai et al. | 84/433 |
| 5,559,297 | A | | 9/1996 | Yoshikawa et al. | |
| 5,574,241 | A | * | 11/1996 | Kumano et al. | 84/439 |
| 5,610,352 | A | | 3/1997 | Yamaguchi | |
| 5,763,799 | A | * | 6/1998 | Kimble | 84/433 |
| 5,796,023 | A | | 8/1998 | Kumano et al. | |
| 5,834,668 | A | * | 11/1998 | Kumano et al. | 84/423 R |
| 5,866,831 | A | * | 2/1999 | Kimble | 84/439 |
| 5,894,099 | A | * | 4/1999 | Niitsuma | 84/433 |
| 6,002,078 | A | * | 12/1999 | Yoshinaga et al. | 84/436 |
| 6,051,768 | A | | 4/2000 | Masubuchi | |
| 6,133,517 | A | | 10/2000 | Masubuchi | |
| 6,191,351 | B1 | * | 2/2001 | Niitsuma | 84/720 |
| 6,329,585 | B1 | | 12/2001 | Chono | |
| 6,531,651 | B2 | | 3/2003 | Kanemitsu et al. | |
| 6,617,502 | B2 | * | 9/2003 | Suzuki et al. | 84/423 R |
| 6,653,542 | B2 | * | 11/2003 | Suzuki et al. | 84/423 R |
| 7,176,370 | B2 | * | 2/2007 | Osuga et al. | 84/433 |
| 7,208,668 | B2 | * | 4/2007 | Shimoda | 84/434 |
| 7,345,235 | B2 | * | 3/2008 | Izutani et al. | 84/720 |
| 2002/0194982 | A1 | * | 12/2002 | Suzuki et al. | 84/423 R |
| 2007/0022864 | A1 | * | 2/2007 | Osuga et al. | 84/423 R |
| 2008/0210079 | A1 | * | 9/2008 | Osuga et al. | 84/423 R |
| 2008/0307944 | A1 | * | 12/2008 | Watanabe | 84/433 |
| 2009/0007756 | A1 | * | 1/2009 | Osuga | 84/423 R |

FOREIGN PATENT DOCUMENTS

| | | |
|---|---|---|
| JP | 2514485 | 7/1996 |
| JP | 2903959 | 3/1999 |

* cited by examiner

KEY STRUCTURE AND KEYBOARD APPARATUS

CROSS REFERENCE TO RELATED APPLICATION

This application is a division of U.S. application Ser. No. 10/940,903 filed on Sep. 13, 2004, the entire contents of which are incorporated herein by reference.

BACKGROUND OF THE INVENTION

1. Field of the Invention

The present invention relates to a key structure which is applied to a key having a wood part, and a keyboard apparatus including the key structure.

2. Description of the Related Art

Conventionally, key structures are known which are mounted in a keyboard apparatus and function as a key pivotally moved by key depression and for which wood or the like is used, as disclosed in Japanese Utility Model Registration Publication No. 2514485 and Japanese Laid-Open Patent Publication (Kokai) No. 2903959. In such a woody key structure, a wood material is used at least for a so-called "visible part" which is visible from the outside during both performance and non-performance, and the key structure presents a woody appearance and hence a high-quality appearance.

However, the conventional key structures have the following problems:

(1) Functional parts for realizing the key operation of each key (e.g. a key return spring, a key switch actuator, a key retainer), and other functional parts for urging the key and a hammer against respective pivots associated therewith, such as a spring having an S shape in side view, are usually provided between the key and a frame of the keyboard apparatus. Therefore, to arrange these functional parts, it is necessary to secure a certain amount of mounting space mainly in a vertical direction.

To this end, if the key structure is of a general resin-made type, it is easy to form a complicated shape, and therefore it is also easy to secure the mounting space for the functional parts. However, the woody key structure usually has its shape formed by machining, e.g. by being cut out of solid wood. Therefore, it is not easy to secure the mounting space for the functional parts. This makes it necessary to set wide spacing between the key and the frame, so that the total height of the keyboard apparatus becomes high, which is contrary not only to the demand for reduction of the size, but also to the demand for reduction of the weight since the amount of wasteful wood part increases.

(2) Further, in general, to provide functional parts formed separately from the key structure, such as a key guide, a sensor, and an LED, on the keyboard apparatus, it is necessary to provide recesses for accommodating such functional parts in the keyboard apparatus. Particularly in the case of woody key structures, it is sometimes necessary to provide such recesses in the wood part thereof. However, if the recesses are small, the dimensions and types of functional parts which can be mounted are limited, which lowers the freedom of mounting.

On the other hand, the key guide needs to have sufficient strength to fully perform its function, and particularly, it is preferable to design the key structure such that the width in the direction of juxtaposition of keys is increased, and the width of the associated recess for the key guide needs to be increased accordingly.

However, if the width of such a recess formed in the wood part is too large, the thickness of side walls of the wood part of the key structure, i.e. the thickness of portions between the recess and key side surfaces is reduced. If the thickness is reduced to about 1 mm, special working means, such as attachment of a reinforcing plate, has to be provided during machining of the woody part for adjustment of the key width, or it becomes difficult to machine wood under proper cutting conditions suited to the machining of the wood.

Further, normally, lubricant is provided between the key guide and the recess, for reduction of sliding frictions. However, if the lubricant is directly applied to the recess formed in the wood part, there arises not only the problem that the lubricant enters the wood part to discolor the wood part, but also the problem that the lubricant eventually stops functioning properly due to dispersion and deterioration thereof.

(3) By the way, in the woody key structure, the wood part is disposed on the top surface of an elongated key base body or on the lower surface of an upper plate member, and fixed to the key base body and/or the upper plate member by an adhesive. Further, in the case where a front butt end member is disposed at a front end (an end toward the player) of the key structure corresponding to the front butt end of the key, it can be envisaged that the front butt end member is provided in fixed relation to the upper plate member or bonded to the front end face of the wood part by an adhesive.

However, the wood part expands and contracts or deforms due to changes in environmental conditions (humidity, temperature, aging, etc.), and therefore, if the key base body and the front butt end member are formed integrally with each other, or they are formed in separate bodies but substantially in contact with each other when the key structure is manufactured, the two members may interfere with each other due to expansion and contraction or deformation of the wood part, which degrades the fixation of the wood part to the two members, and in the worst case, separation of them occurs. Further, in a keyboard apparatus having an upper plate member, if the wood part is secured to the upper plate member and at the same time the front butt end member is provided in fixed relation to the upper plate member, the fixation of the wood part to the upper plate member is degraded due to expansion and contraction, or deformation of the wood part. If the fixation of the wood part to the upper plate member, the key base body, or the front butt end member is degraded, the front end of the key can become faulty. Thus, required durability of the key cannot be ensured.

Further, a keyboard apparatus in general is provided with a limiting member, such as a stopper, for limiting a key depression end position. The limiting member is preferably provided at a location where the front end of each key is brought into contact therewith so as to provide the highest limiting effect. However, if the limiting member is disposed below the front end of the key and the front butt end member is disposed in contact with the limiting member, the fixation of the wood part to the front butt end member is degraded due to a shearing force applied between the front butt end member and the wood part as the key depressing operation is repeatedly carried out. Moreover, in the case where the keyboard apparatus has an upper plate member, if the wood part is secured to the upper plate member, and at the same time the front butt end member is provided in fixed relation to the upper plate member, the fixation of the wood part to the upper plate part is degraded due to the repeated key depressing operations. When the fixation of the wood part to the upper plate member or the front butt end member is degraded, the front end of the key can become faulty. Thus, required durability of the key cannot be ensured. On the other hand, if the limiting member is disposed at a location closer to the rear end of the key so as to prevent the key from being brought into contact with the front butt end member, the limiting function is weakened due to a change in the lever ratio, which makes it difficult to perform a proper limiting operation.

Furthermore, in addition to giving a woody appearance, the minimizing of the area where the wood part is disposed contributes not only to saving of the expensive material but also to reduction of the weight of the key itself, and therefore it is essential to design the key structure while considering the relationship between the front butt end member and the wood part in view of these merits.

(4) By the way, there is also conventionally known a key structure applied to keys of a keyboard apparatus, in which wood is used as a base material and the surface (top) of the base material as the depressing surface of the key is coated with resin or the like. However, although the key structure having resin or the like coated on the surface of the base material gives a high-grade texture due to the wood being used as the base material, this key structure is more difficult to machine compared with the resin-based key structure, and therefore it is difficult to manufacture key structures uniform in quality at low costs.

(5) Further, wooden keys originally designed for acoustic pianos are often also used for manufacturing the woody key structure, since they are easily available. The key structure is normally provided with not only a pivot about which the key is moved and a guided mechanism for being guided by a key operation guide, but also an engaging part ("associated element-engaging part" or "key functional part") for driving an associated element, such as a mass member or a key switch, and an engaging part for engaging an associated element. However, if these engaging parts are made of wood, high machining tolerances cannot be required of driving sections thereof, due to the limited accuracy of woodworking. On the other hand, if the key structure is made of resin or the like as a one-piece member including the pivot and the engaging parts, a woody appearance cannot be obtained at all, and further, the touching feeling tends to be adversely affected since the rigidity of the resin key is lower compared with the wooden key.

(6) Further, in this type of key structure, "the associated element-engaging parts" and "the key functional parts" are also often formed at the wood part by machining the same, and therefore the freedom of design concerning the functions and shapes thereof is low, and the machining accuracy is low with lots of limitations on machining. This makes it difficult to exhibit the key functions with high accuracy.

SUMMARY OF THE INVENTION

It is a first object of the present invention to provide a key structure which is capable of giving a woody appearance to the key, and increasing the freedom of mounting at least one functional part formed as a separate part from the key structure, while maintaining excellent machinability.

It is a second object of the present invention to provide a key structure which is capable of giving a woody appearance to the key, and maintaining the effect of lubricating at least one functional part that is slidingly moved during key-depressing operation, for a long time period.

It is a third object of the present invention to provide a key structure which is capable of giving a woody appearance to the key, and preventing the front end of the key from becoming faulty due to changes in environmental conditions to thereby secure desired durability of the key.

It is a fourth object of the present invention to provide a key structure which is capable of giving a woody appearance to the key, and securing a proper pivotal movement-limiting capability, as well as preventing the front end of the key from becoming faulty due to key-depressing operations to thereby secure durability of the key.

It is a fifth object of the present invention to provide a key structure which is capable of giving a woody appearance to the key, and reducing wasteful use of a wood to thereby reduce the size and weight thereof.

It is a sixth object of the present invention to provide a key structure which is capable of giving a woody appearance to the key, and reducing the size and weight of a keyboard apparatus employing the key structure.

It is a seventh object of the present invention to provide a key structure which is capable of giving a woody appearance to the key at a low cost.

To attain the first object, in a first aspect of the present invention, there is provided a key structure that is mountable in a keyboard apparatus, for functioning as a white key pivotally moved by key-depressing operation, comprising an upper plate member (50) having an increased width part (50*h*) corresponding to an end of the white key toward a player, the increased width part having a lower surface, and a wood part (60) secured to the lower surface of at least the increased width part of the upper plate member, the wood part having an increased width part (60*h*) having a substantially same width as the increased width part of the upper plate member, the wood part having a recess (121) formed in a part thereof including the increased width part, the recess opening downward and having a width (W0) which is not less than 50% and not more than 80% of a width (B0) of the increased width part of the wood part.

With the construction of the preferred embodiment, the front end butt member is not located above the limiting member, and therefore, even if the key is depressed with a very strong force, the front butt end member will not be brought into abutment with the limiting member. This makes it possible to more positively prevent the front end of the key from becoming faulty due to repeated key-depressing operations.

To attain the second object, in a second aspect of the present invention, there is provided a key structure that is mountable in a keyboard apparatus, for functioning as a key pivotally moved by key-depressing operation, comprising an upper plate member having a lower surface, a wood part secured to the lower surface of the upper plate member, the wood part having a recess (121) formed therein and opening downward, the recess receiving at least one functional part (75) for sliding movement relative to the key structure via a lubricant during key-depressing operation, and a lubricant-avoiding mechanism part (47) provided in the recess, for providing blockage between the lubricant and the wood part.

With the construction of the second aspect of the present invention, the wood part gives a woody appearance to the key. Further, the lubricant-avoiding mechanism part provided in the recess shuts off lubricant applied to a functional part from the wood part with which the functional part is brought into sliding contact during key-depressing operation. This prevents lubricant from entering the wood part, to thereby maintain required lubricating performance over a long term.

To attain the third object, in a third aspect of the present, there is provided a key structure (200) that functions as a key pivotally moved by key-depressing operation, comprising an end toward a player, a key base (68) having an upper part and an end toward the player, a wood part (67) secured to the upper part of the key base, and a front butt end member (81) secured to the end toward the player, of the key structure, wherein a predetermined clearance (CL1) in a longitudinal direction of the key base is provided between the front butt end member and the end toward the player, of the key base.

With the construction of the third aspect of the present invention, the wood part gives a woody appearance to the key. Further, a predetermined clearance in a longitudinal direction of the key base is provided between the front butt end member and the end of the key base toward the player. Therefore, even if the wood part expands and contracts, or deforms, due to changes in environmental conditions, the front butt end member does not interfere with the key base. This prevents deterioration of the fixation of the front butt end member to the wood part e.g. when the front butt end member is fixed to the end of the wood part toward the player. Further, when the upper plate member is provided such that the wood part is secured to the upper plate member and the front butt end member is provided in fixed relation to the upper plate member, it is possible to prevent deterioration of the fixation of the wood part to the upper plate member. Therefore, it is possible to avoid failure of the end of the key toward the player due to changes in environmental conditions, to thereby secure desired durability, while giving a woody appearance to the key.

Preferably, the wood part has an end (67*b*) toward the player, and the front butt end member is secured to the end toward the player, of the wood part.

With the construction of this preferred embodiment, even if the wood part expands and contracts, or deforms, due to changes in environmental conditions, the front butt end member does not interfere with the key base. This prevents deterioration of the fixation of the front butt end member to the wood part.

To attain the fourth object, in a fourth aspect of the present, there is provided a key structure (200) that functions as a key pivotally moved by key-depressing operation, comprising an end toward a player, a key base having an upper part, and an end toward the player having a lower surface (68*aa*), a wood part secured to the upper part of the key base, and a front butt end member made of resin, the front butt end member having a lower end (81*a*), and being secured to the end toward the player, of the key structure, wherein the front butt end member extends along the wood part to a location where the front butt end overlaps the key base in front view, and wherein the lower surface of the player side end of the key base is located lower than the lower end of the front butt end member.

With the construction of the fourth aspect of the present invention, the wood part gives a woody appearance to the key. Further, when a limiting member for setting. a limit to a key depression-terminating position where the key depression is terminated is disposed below the end of the key structure toward the player, the end of the key structure toward the player is brought into abutment with the limiting member, which provides the optimum pivotal movement-limiting function. Even with such a configuration, the key depression-terminating position is determined by the abutment of the end of the key base toward the player against the limiting member, and contact between the front butt end member and the limiting member is avoided. This prevents deterioration of the fixation of the front butt end member to the wood part which can be caused by repeated key-depressing operations e.g. when the front butt end member is fixed to the end of the wood part toward the player. Further, when the upper plate member is provided with the wood part secured to the upper plate member and the front butt end member is provided in fixed relation to the upper plate member, it is possible to prevent deterioration of the fixation of the wood part to the upper plate member which can be caused by repeated key-depressing operations. Therefore, it is possible to secure a proper pivotal movement-limiting function of the limiting member, and at the same time prevent the end of the key toward the player from becoming faulty due to key depressing operations, to thereby secure desired durability of the key structure, while giving a woody appearance to the key. Moreover, the front butt end member extends along the wood part to a location where the front butt end overlaps the key base in front view, so that the juncture between the wood part and the key base is visible, to provide an excellent appearance of the key. Further, since there is no juncture in the front end of the key structure, it is possible to obtain stable guiding performance.

Preferably, the wood part has an end toward the player, and the front butt end member is secured to the end toward the player, of the wood part.

With the construction of this preferred embodiment, it is possible to prevent deterioration of the fixation of the front butt end member to the wood part which can be caused by repeated key-depressing operations.

Preferably, the key structure is mountable in a keyboard apparatus, the keyboard apparatus having a limiting member (83) formed therein and having an end toward the player, the limiting member being disposed directly below the lower surface of the end toward the player, of the key base, for abutment therewith, to thereby limit a key depression-terminating position of the key structure, and the front butt end member is located toward the player with respect to the end toward the player, of the limiting member.

With the construction of the preferred embodiment, the front end but member is not located above the limiting member, and therefore, even if the key is depressed with a very strong force, the front butt end member will not be brought into abutment with the limiting member. This makes it possible to more positively prevent the front end of the key from becoming faulty due to repeated key-depressing operations.

To attain the fourth object, in a fifth aspect of the present, there is provided a key structure (300) that functions as a key pivotally moved by key-depressing operation, comprising an end toward a player, a key base (97) having an upper part, and an end toward the player, a wood part (95) secured to the upper part of the key base, the wood part having an end (95*b*) toward the player having a lower surface (95*a*), and a front butt end member (96) secured to the end toward the player, of the key structure, the front butt end member having a lower end (96*a*), wherein the end toward the player, of the wood part is located toward the player with respect to the end toward the player, of the key base, such that the lower surface of the end toward the player, of the wood part is exposed, and wherein the lower surface of the end toward the player, of the wood part is located lower than the lower end of the front butt end member is.

With the construction of the fourth aspect of the present invention, the wood part gives a woody appearance to the key. Further, when a limiting member for setting a limit to a key depression-terminating position where the key depression is terminated is disposed below the end of the key structure toward the player, the end of the key structure toward the player is brought into abutment with the limiting member, which provides the optimum pivotal movement-limiting function. Even with such a configuration, the key depression-terminating position is determined by the abutment of an exposed part of the lower surface of the end of the wood part toward the player against the limiting member, and contact between the front butt end member and the limiting member is avoided. This prevents deterioration of the fixation of the front butt end member to the wood part due to repeated key-depressing operations e.g. when the front butt end member is fixed to the end of the wood part toward the player. Further, when the upper plate member is provided with the wood part secured to the upper plate member and the front butt end member is provided in fixed relation to the upper plate member, it is possible to prevent deterioration of the fixation of the wood part to the upper plate member due to repeated key-depressing operations. Therefore, it is possible to secure a proper pivotal movement-limiting function of the limiting member, and at the same time prevent the front end of the key from becoming faulty due to key depressing operations, to thereby secure desired durability of the key structure, while giving a woody appearance to the key.

Preferably, the front butt end member is secured to the end toward the player, of the wood part.

With the construction of this preferred embodiment, it is possible to prevent deterioration of the fixation of the front butt end member to the wood part due to repeated key-depressing operations.

To attain the fifth object, in a sixth aspect of the present, there is provided s key structure that functions as a key pivotally moved by key-depressing operation, comprising an end toward a player, a holding member (68), a wood part (67) secured to the holding member, the wood part having an end (67*b*) toward the player, and a lower part (67*a*), and a front butt end member (81) secured to the end toward the player, of the key structure, the front butt end member having a lower end (81*a*), wherein the lower part of the wood part is located higher than the lower end of the front butt end member.

With the construction of the sixth aspect of the present invention, the wood part gives a woody appearance to the key. Further, a part of the key upward of the front butt end member is not visible from the front, and therefore, by disposing the wood part above the lower surface of the front butt end member, it is possible to make effective use of a wood material while securing the woody appearance of the key.

To attain the sixth object, in a seventh aspect of the present, there is provided a key structure (400) that has a pivot (21), and an end (128) toward a player, and is mountable in a keyboard apparatus such that the end thereof toward the player is pivotally moved about the pivot by key-depressing operation to thereby function as a key, comprising a wood part (54), a holding member (125, 55) that fixedly holds the wood part, and a non-visible part (R2) that exists in a region between the end toward the player and the pivot in a longitudinal direction of the key structure, and is not visible from outside during performance of the keyboard apparatus an during non-performance thereof, wherein the non-visible part has a recess (58) formed therein, for having mounted therein at least one functional part for realizing at least a key operation of the key structure.

With the construction of the seventh aspect of the present invention, the recess is provided, which makes it possible to shorten the distance between the frame and the key when a functional part, such as a key return spring, is mounted, to thereby save space in the vertical direction. Further, the weight of the keyboard apparatus can be reduced due to reduction of wasteful use of the wood material of the wood part.

Preferably, the wood part has a lower part, and wherein the holding member includes a key base that fixedly holds the lower part of the wood part, the recess being formed in the key base.

With the construction of this preferred embodiment, the recess is provided in a key base which can be made of resin. Therefore, the recess can be formed more easily compared with the case where it is formed in the wood part.

Preferably, the functional part comprises a key return spring (57) that urges the key structure in a returning direction, and wherein the recess is formed in a bottom of the key base.

With the construction of the preferred embodiment, the recess can be formed with ease, and required accuracy can be secured with ease.

Preferably, the wood part has a recess formed by counter boring in a part thereof corresponding to the recess formed in the key base.

To attain the sixth object, in an eighth aspect of the present, there is provided a key structure that has a pivot, and an end toward a player, and is mountable in a keyboard apparatus such that the end thereof toward the player is pivotally moved about the pivot by key-depressing operation to thereby function as a key, comprising an elongated key base having an upper part, and a free end, a wood part secured to the upper part of the key base, the wood part having an upper part, and a lower surface, an upper plate member fixedly held by the upper part of the wood part, and a guided part operable when the end toward the player is pivotally moved about the pivot, to cause the end toward the player to be guided thereby, wherein the guided part has a pair of hanging parts (42) hanging downward from the free end of the key base in a key-depressing direction, the pair of hanging parts have respective lower ends, and left and right inner walls, and the guided part is formed by the left and right inner walls of the pair of hanging parts, and a space defined between the left and right walls and extending at least from a location of the lower ends of the hanging parts to a location of the lower surface of the wood part.

With the construction of the eighth aspect of the present invention, a required vertical length of the guided part can be secured by the thickness of the key base, which provides stable guiding performance of the guided part, and what is more, it is possible to reduce the size and weight of the keyboard apparatus while giving a woody appearance to the key.

Preferably, the key structure further comprises a front butt end member made of resin and extending along the wood part from the upper plate member to a location where the front butt end member overlaps the key base in front view, the front butt end member abutting on the guided part.

With the construction of the preferred embodiment, the front butt end member extends along the wood part from the upper plate member to a location where the front butt end overlaps the key base in front view, so that the junctures between the upper plate member, the wood part, and the key base are not visible to provide an excellent appearance to the key. Further, there is no juncture in the front end of the key structure, which provides stable guiding performance of the guided part.

Preferably, the pair of hanging parts have respective upper parts, and the key structure further comprises a pair of extended parts (47A, 47B) extending from the respective upper parts toward a surface of the key, and the wood part has a recess (121) formed by counter boring in a part thereof corresponding to the pair of extended parts.

With the construction of this preferred embodiment, a required vertical length of the guided part can be secured by the thickness of the key base and the depth of the recess formed by counter boring in the wood part, which provides more stable guiding performance of the guided part.

Preferably, the pair of extended parts have respective ends toward the surface of the key, and the guided part has a closing part (47U) closing a space defined between the ends of the pair of extended parts.

With the construction of the preferred embodiment, when lubricant is applied to the inside of the guided part, the closed part shuts off the lubricant from the wood part. This prevents the lubricant from entering the wood part to maintain the lubricating performance over a long term.

To attain the sixth object, in a ninth aspect of the present, there is provided a key structure (500) that has a pivot, an end (128) toward a player, and a rear part, and is mountable in a keyboard apparatus such that the end thereof toward the player is pivotally moved about the pivot by key-depressing operation to thereby function as a key, comprising a wood part (62) having a lower surface (62*a*), a holding member (125, 63) that fixedly holds the wood part, and a non-visible part that exists at least below the rear part, and is not visible from outside during performance of the keyboard apparatus and during non-performance thereof, wherein the non-visible part has a recess (64) formed therein, for having mounted therein at least one functional part (57) for realizing at least a key operation of the key structure, the recess being defined by the lower surface of the wood part sloping upward in a rearward direction of the key structure away from the end toward the player.

With the construction of the ninth aspect of the present invention, the recess is provided in a non-visible part. This contributes to the reduction of the size and weight of the keyboard apparatus, and securing a woody appearance.

Preferably, the wood part is disposed such that its lower surface is positioned below a key depressing surface (L1) of an adjacent key structure which is in the key depression-terminating position and extends substantially parallel thereto. With this construction, it is possible to secure a woody appearance of the key while using the minimum amount of the wood part, thereby efficiently saving the material for the wood part.

To attain the seventh object, in a tenth aspect of the present, there is provided a key structure that is mountable in a keyboard apparatus, comprising a key base made of resin, the key base comprising an upper part (10*a*, 33*a*, 31), a lower part (10*c*, 33*e*, 33*d*, 32*b*), and a connecting part (10*b*, 33*b*, 33*c*, 32*a*) connected to the upper part, and an intermediate member (20L, 20R, 34L, 34R) that is disposed in a region between the upper part and the lower part of the key base, where the intermediate member is visible from outside during performance of the keyboard apparatus, wherein the intermediate member is formed of a woody material, the upper end of the intermediate member being in contact with the upper part of the key base, and the lower end of the intermediate member being extended to a vicinity of the lower part of the key base.

With the construction of the tenth aspect of the present invention, it is possible to give a woody appearance to the key at a low cost.

Preferably, the key structure has opposite lateral sides, and is configured for use as a white key, and the intermediate member is provided only at one of the opposite lateral sides at which a black key is not adjacent to the key structure.

With the construction of the preferred embodiment, the intermediate member is disposed so as to occupy the minimum possible area of the key structure, thus enabling further reduction of the cost while maintaining a woody appearance.

To attain the first object, in a eleventh aspect of the present, there is provided a keyboard apparatus comprising a plurality of keys, at least one of the plurality of keys being formed by the key structure according to the first aspect of the present invention.

To attain the second object, in a twelfth aspect of the present, there is provided a keyboard apparatus comprising a plurality of keys, at least one of the plurality of keys being formed by the key structure according to the second aspect of the present invention.

To attain the third object, in a thirteenth aspect of the present, there is provided a keyboard apparatus comprising a plurality of keys, at least one of the plurality of keys being formed by the key structure according to the third aspect of the present invention.

To attain the fourth object, in a fourteenth aspect of the present, there is provided a keyboard apparatus comprising a plurality of keys, at least one of the plurality of keys being formed by the key structure according to the fourth aspect of the present invention.

To attain the fourth object, in a fifteenth aspect of the present, there is provided a keyboard apparatus comprising a plurality of keys, at least one of the plurality of keys being formed by the key structure according to the fifth aspect of the present invention.

To attain the fifth object, in a sixteenth aspect of the present, there is provided a keyboard apparatus comprising a plurality of keys, at least one of the plurality of keys being formed by the key structure according to the sixth aspect of the present invention.

To attain the sixth object, in a seventeenth aspect of the present, there is provided a keyboard apparatus comprising a plurality of keys, at least one of the plurality of keys being formed by the key structure according to the seventh aspect of the present invention.

To attain the sixth object, in an eighteenth aspect of the present, there is provided a keyboard apparatus comprising a plurality of keys, at least one of the plurality of keys being formed by the key structure according to the eighth aspect of the present invention.

To attain the sixth object, in a nineteenth aspect of the present, there is provided a keyboard apparatus comprising a plurality of keys, at least one of the plurality of keys being formed by the key structure according to the ninth aspect of the present invention.

To attain the seventh object, in a twentieth aspect of the present, there is provided a keyboard apparatus comprising a plurality of keys, at least one of the plurality of keys being formed by the key structure according to the tenth aspect of the present invention.

The above and other objects, features, and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
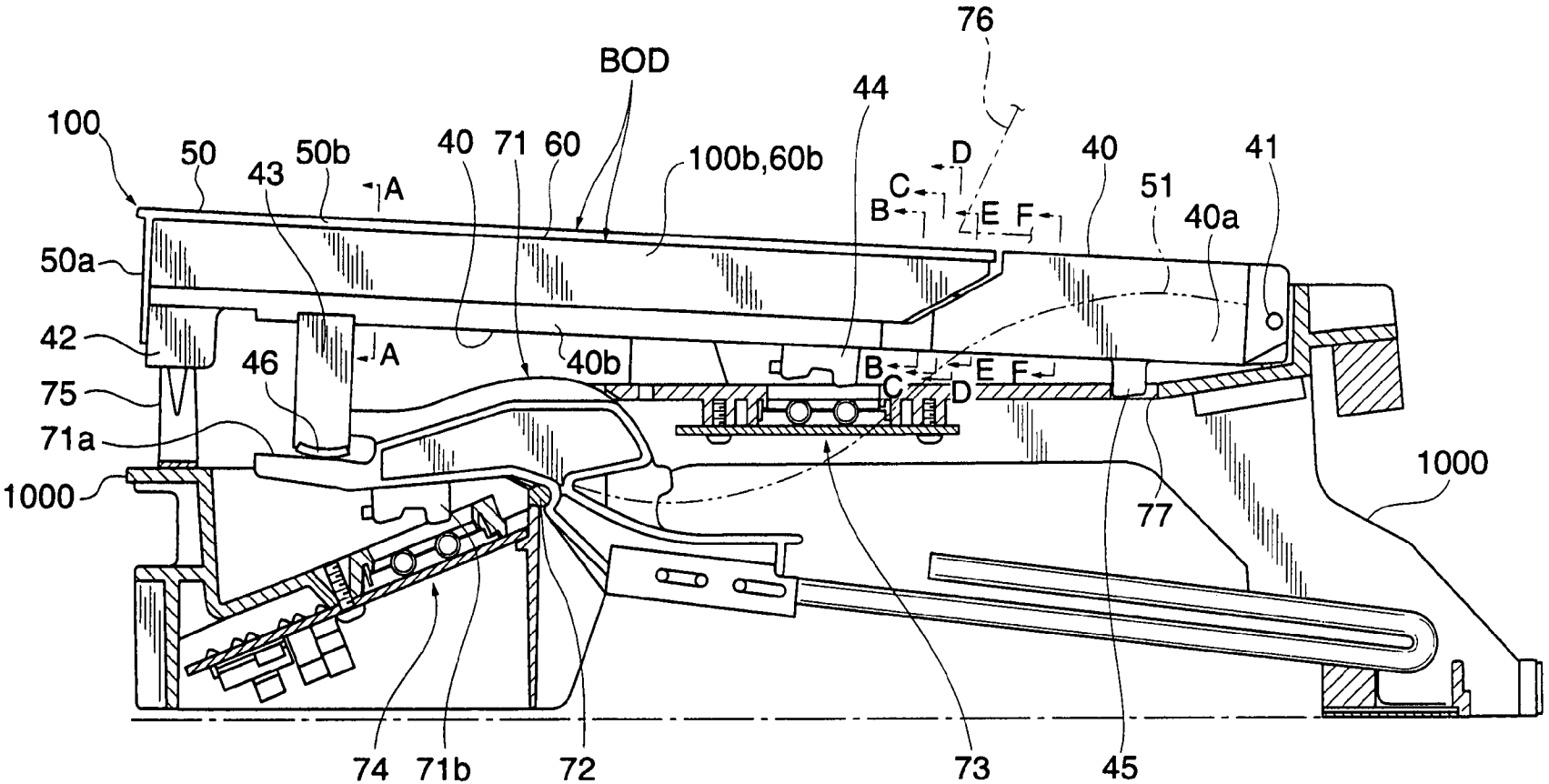
FIG. 1 is a cross-sectional view showing the construction of a keyboard apparatus (musical keyboard instrument) including a key structure according to a first embodiment of the present invention.

FIG. 1 is a cross-sectional view showing the construction of a keyboard apparatus (musical keyboard instrument) including a key structure according to a first embodiment of the present invention The key structure 100 according to the first embodiment functions as one of a plurality of keys of a keyboard apparatus used mainly as a musical instrument (musical keyboard instrument), which are pivotally moved by key depression. FIG. 1 shows a cross-section of the keyboard apparatus, taken on a portion thereof between a B key and a C key, and therefore FIG. 1 is a right side view of one key structure 100, which is the B key, as viewed from the player. The key structure 100 is applied to a white key, but the construction of the key structure 100 may be applied not only to white keys but also to black keys. In the following description, a side of the present keyboard apparatus and the key structure 100 toward the player will be referred to as "the front side".

The key structure 100 is comprised of a key base 40, and a key body BOD, which are formed in one piece. The key body BOD is comprised of an upper plate (upper plate member) 50, and a wood part 60 made of wood. The upper plate 50 is comprised of a front part 50*a*, and an upper plate part 50*b* which provides a key operating surface. The front part 50*a* and the upper plate part 50*b* are made of resin and formed integrally with each other. The wood part 60 has approximately the same length as the upper plate part 50*b* of the upper plate 50, and bonded to the upper plate part 50*b* and the front part 50*a*, thereby being united with the upper plate 50 to form the key body BOD.

The key base 40 is comprised of a key base end 40*a*, and an extended part 40*b* extending forward from the key base end 40*a*, which are made of resin and formed integrally with each other. Further, the extended part 40*b* has a key-guided part 42, a mass member-driving part 43, a key actuator 44, and a key fall-off prevention mechanism part 45, as key functional parts ("the associated element-engaging parts"), formed integrally therewith. The extended part 40*b* extends substantially parallel to the key body BOD along the longitudinal axis thereof up to the front part 50*a* of the upper plate part 50. The key base end 40*a* also corresponds to the rear end of the key structure 100. The key base end 40*a* has a rear end thereof provided with a pivot 41 about which the key structure 100 is allowed to move vertically. The mass member-driving part 43 has a lower end on which is mounted a sliding member 46, for ensuring smooth sliding thereof.

On the other hand, a mass member 71 is disposed below each key structure 100 in association therewith. The mass member 71 has a driven part 71*a* driven by the sliding member 46 via the mass member-driving part 43 of the key base 40 according to a key-depressing operation. This causes the mass member 41 to move about a mass member pivot 72 to give adequate key-depression feeling. Further, the present keyboard apparatus is provided with a first key switch 73 and a second key switch 74 which are both of a 2-make type. The first key switch 73 operates when depressed by the key actuator 44 of the key base 40, to detect key movements, such as key depression and key release. The second key switch 74 operates when depressed by a key actuator 71*b* provided on the mass member 71, to detect the key movements. The two key switches 73 and 74 detect the key movements including an off-touch state of the key, at respective different time points in a key operation sequence, whereby various types of musical tone control can be carried out based on results of the detections.

The present keyboard apparatus is also provided with a key operation guide 75 and an engaging part 77 as key functional parts. The key guided part 42 of the key structure 100 is guided by the key operation guide 75 during key operation, whereby the wobbling motion in the direction of juxtaposition of keys (transverse direction of the key structure 100) is limited. A description will be given hereinafter of details of the configurations of the key guided part 42 and the key operation guide 75. The key fall-off prevention mechanism part 45 is engaged with the engaging part 77 to thereby prevent the key structure 100 from falling off mainly in a forward direction during key operation.

Further, a spring 51 in the form of a fork in plan view, which presents an S shape in side view, extends from the vicinity of the mass member pivot 72 to the rear of the key structure 100, in a suspended fashion. The spring 51 urges the key structure 100 rearward, and at the same time the mass member 71 against the mass member pivot 72, thereby preventing the key structure 100 and the mass member 71 from easily falling off a chassis 1000.

FIGS. 2A to 2F are cross-sectional views showing the key structure taken along lines A-A to F-F in FIG. 1. FIGS. 2A to 2F illustrate the B key, by way of example, which is formed with a recess for allowing disposition of a black key (A# key) adjacent thereto, and therefore in these figures, the key structure 100 has a left side (side 100*a*), as viewed from the player, thereof reduced in width or indented in the transverse direction.

Figure 2A:
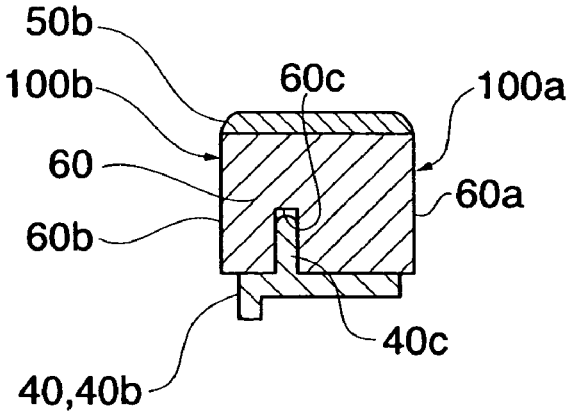
FIG. 2A is a cross-sectional view of the key structure, taken along line A-A in FIG. 1.

As shown in FIG. 2A, the key structure 100 is configured such that the wood part 60 is sandwiched between the upper plate part 50*b* of the upper plate 50 and the key base 40. The top of the extended part 40*b* of the key base 40 is formed with a ridge-like protrusion 40*c* extending from the front end to the vicinity of a juncture between the extended part 40*b* and the key base end 40*a*. Further, the wood part 60 is formed with a groove-like recess 60*c* configured for allowing the protrusion 40*c* to be fitted therein. The key structure 100 is fabricated by first forming the key body BOD, then fitting the protrusion 40*c* into the groove-like recess 60*c* of the wood part 60, followed by the wood part 60 and the extended part 40*b* being bonded to each other.

The wood part 60 also plays the role of giving a woody appearance to the key structure 100. That is, when an adjacent key is depressed, a part of a side surface of the key structure 100 is exposed to the view of the player. However, side surfaces 60*a* and 60*b* of the wood part 60 made of wood forms the sides 100*a* and 100*b* of the key structure 100, which makes the side surfaces 60*a* and 60*b* of the wood part 60 visible to the player, thereby causing the entire key structure 100 to appear as if it were made of wood except for its upper and front surfaces. This causes the key structure to present a woody appearance and hence a high-quality appearance.

Further, as shown in FIG. 1, the keyboard apparatus includes a panel part 76 disposed at a location upward of the key structure 100. The panel part 76 is equipped with various operating elements, not shown, and a display section, not shown, and also plays the role of a hiding part for hiding a part of the keyboard apparatus rearward thereof. The key body BOD, on which the wood part 60 is provided, extends to a location rearward of the panel part 76, and therefore the boundary of the key body BOD and the key base end 40*a* of the key base 40 is prevented from being viewed by the player, which improves the appearance of the key structure 100.

Thus, the side surfaces 60*a* and 60*b* as the woody surface of the wood part 60 are disposed on the sides of the key body BOD in the longitudinal direction of the keyboard apparatus, which brings the woody surfaces 60*a* and 60*b* of the wood part 60 to come into view of the player during key depression of adjacent keys, and which adds a woody appearance to the key structure. Further, the key body BOD and the key base 40, having respective elongated shapes, are made movable in unison, and at the same time the extended part 40*b* of the key base 40 extends almost parallel to the key body BOD along the longitudinal axis thereof. Furthermore, the extended part 40*b* is formed integrally with a plurality of key functional parts, such as the key guided part 42 for realizing key functions. This increases the freedom of designing the functions and shapes of the key functional parts, and the accuracy of machining of these parts, to easily ensure very accurate key functions, compared with the conventional case where a wooden key is employed and the key functional parts are formed at the wood part of the wooden key by machining the same. Therefore, it is possible to increase the freedom of the design of the key functional parts to easily ensure high accuracy with which key functions are performed, while giving a woody appearance to the key.

What is more, compared with the conventional key structure in which coating of resin or the like is provided on the surface of a wooden base material, it is easy to perform machining, which makes it possible to produce key structures uniform in quality at a low cost. Therefore, the woody appearance can be added to the key at a low cost.

Further, since the key base 40 is formed of resin, it is possible to increase the freedom of design, durability, and wear resistance of the key base 40 including the key functional parts, thereby enabling the key functions to be exhibited with even higher accuracy for a long time period. Moreover, the wood part 60 can be regarded as a solid component part filled inside the key structure 100, whereby high rigidity of the key is ensured.

Furthermore, the wood part 60 is disposed at a longitudinally intermediate location between the pivot 41 of the rear end of the key structure 100 and the front part 50*a* of the upper plate 50 corresponding to the front end of the key structure 100. Therefore, as is distinct from the prior art, the present key structure 100 presents a woody appearance without using a wooden key for acoustic pianos and forming the same into a seesaw-type key with a pivot thereof disposed at a longitudinally intermediate location. Moreover, it is possible to reduce the length of a part thereof rearward of the pivot, compared with the prior art. This makes it possible to decrease the longitudinal size and weight of the key, while giving a woody appearance to the key.

Further, the key base 40 is formed by a resin member formed integrally with "the associated element-engaging parts", such as the pivot 41 and the key-guided part 42, and therefore compared with the case where these associated element-engaging parts are formed of a wood material, it is possible to easily achieve high accuracy, and increase the freedom of design of their shapes. In this respect, if the key structure is a one-piece member with which the pivot and the associated element-engaging parts are simply formed integrally, as in the prior art, no woody appearance is presented, and further the rigidity of the key is reduced, adversely affecting the key touch. In contrast, in the present embodiment, the wood part 60 can be regarded as a solid component part filled inside the key structure 100, which ensures high rigidity of the key. Due to the high rigidity, the key-depressing force is accurately transmitted to the associated element-engaging parts, which increases the key touch due to increased touch-detecting accuracy. Moreover, the high rigidity contributes to suppression of warpage of the key structure 100. Thus, the present key structure 100 can maintain the accuracy of performance of the key functions and increase the rigidity of the key, while giving a woody appearance to the key.

Now, the provision of the wood part 60 only for the key structure 1 for a white key alone makes it possible to reduce the cost. Besides, if the wood part 60 is provided only at a side of the key structure which is not adjacent to a black key, it results in the wood part 60 occupying the minimum possible area of the key structure, thus enabling further reduction of the cost while maintaining the woody appearance.

From the viewpoint of adding the woody appearance, the construction of the key structure 100 is not limited to the illustrated example, but a suitable one of constructions shown in FIGS. 3A to 3D may be employed.

FIGS. 3A to 3D are cross-sectional views of other examples of the key structure according to the first embodiment, which show a cross-section corresponding to that of FIG. 2A of the above-described embodiment.

Figure 3A:
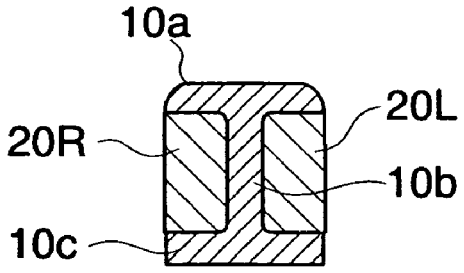
FIG. 3A is a cross-sectional view showing the construction of another example of the key structure according to the first embodiment.

For example, FIG. 3A shows an example in which parts corresponding to the upper plate 50 and the key base 40 are formed integrally with each other and made of resin. More specifically, an upper plate 10*a* and a lower plate 10*c* are connected by a connecting part 10*b*, to form a shape of laterally buckled "H". In this example, the wood part is comprised of divided parts 20L and 20R which are arranged on the opposite lateral sides of the connecting part 10*b*, to thereby form a key structure.

Figure 3B:
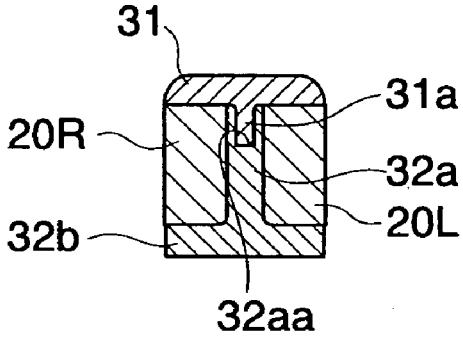
FIG. 3B is a cross-sectional view showing the construction of another example of the key structure according to the first embodiment.

In the case of an example in FIG. 3B, a ridge-like protrusion 31*a* is formed on an upper plate 31 made of resin in a fashion extending downward therefrom, and a connecting part 32*a* and a lower plate 32*b* are formed integrally with each other and made of resin, with a groove-like recess 32*aa* formed in the top of the connecting part 32*a*, for allowing the protrusion 31*a* to be fitted therein. In assemblage, the protrusion 31*a* of the upper plate 31 is fitted into the recess 32*aa* of the connecting part 32*a* and bonded thereto, and the divided parts 20L and 20R are arranged similarly to the example of FIG. 31A, whereby a key structure in which the parts thereof are united into a one-piece member is formed.

Figure 3C:
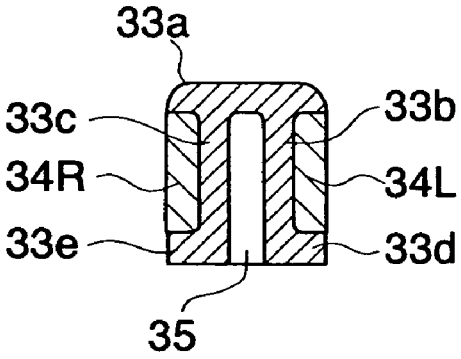
FIG. 3C is a cross-sectional view showing the construction of another example of the key structure according to the first embodiment.

Further, as shown in FIG. 3C, an upper plate part 33*a*, and lower plate parts 33*d* and 33*e* may be connected by two connecting parts 33*b* and 33*c*, to form a one-piece member. In this case, a recess 35 is formed between the connecting parts 33*b* and 33*c*, and wood parts 34L and 34R thinner than the wood parts 20L and 20R are arranged outward of the connecting parts 33*b* and 33*c*, to thereby form a key structure.

Figure 3D:
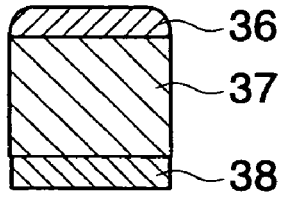
FIG. 3D is a cross-sectional view showing the construction of another example of the key structure according to the first embodiment.

Further, as shown in FIG. 3D, a wood part 37 may be vertically sandwiched between an upper plate part 36 and a lower plate part 38 both made of resin, and bonded thereto, to thereby form a key structure in which the parts thereof are united into a one-piece member.

Figure 4A:
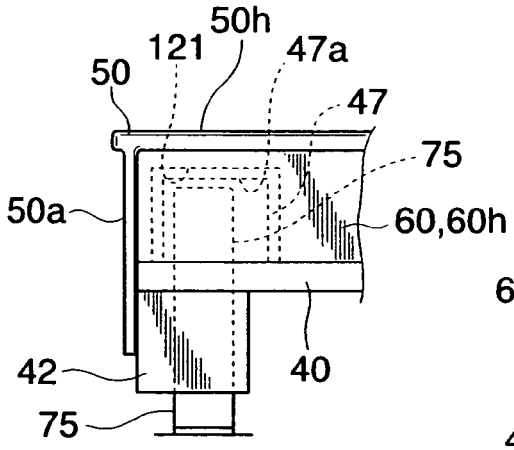
FIG. 4A is a side view showing the construction of the front end of the key structure according to the first embodiment.
Figure 4C:
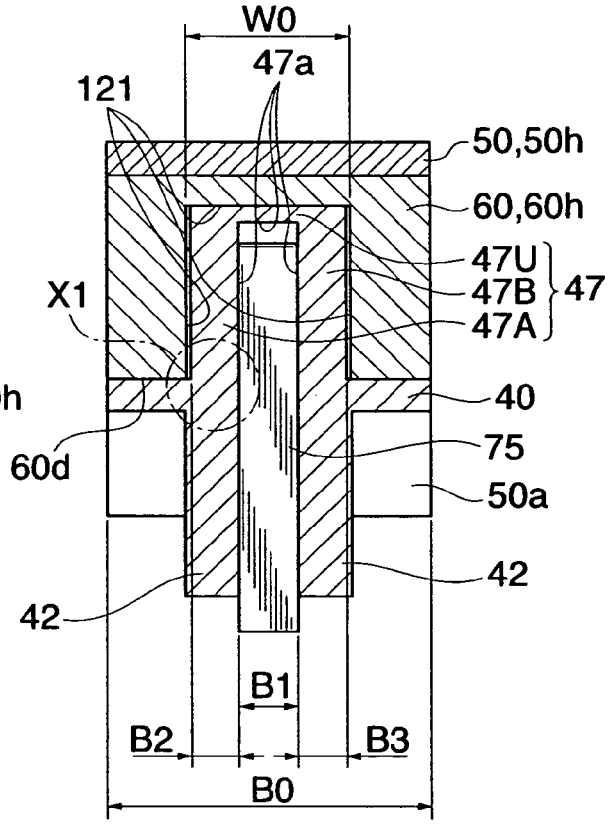
FIG. 4C is a cross-sectional view of the front end of the key structure, taken along line G-G in FIG. 4B.
Figure 4B:
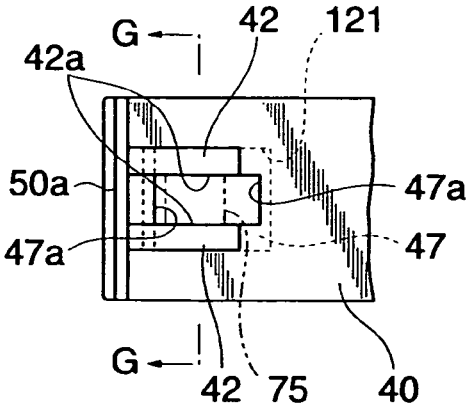
FIG. 4B is a bottom view of the foremost end of the key structure.
Figure 4D:
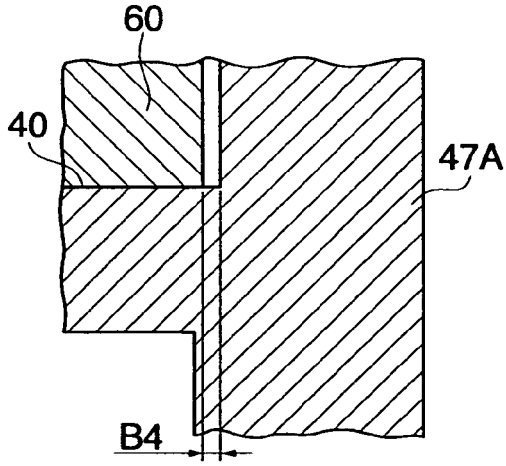
FIG. 4D is an expanded view of an X1 part appearing in FIG. 4C.

FIG. 4A is a side view of a front end of the key structure 100 according to the first embodiment; FIG. 4B is a bottom view of the front end of the key structure; FIG. 4C is a cross-sectional view of the front end of the key structure, taken along line G-G in FIG. 4B; and FIG. 4D is an expanded view of an X1 part appearing in FIG. 4C.

Figure 2B:
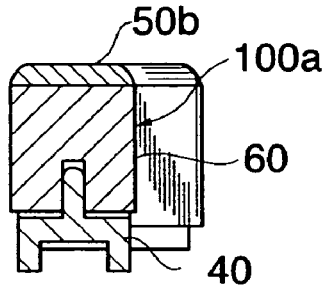
FIG. 2B is a cross-sectional view of the key structure, taken along line B-B in FIG. 1.
Figure 2C:
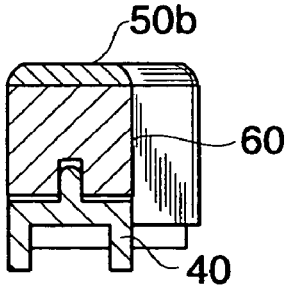
FIG. 2C is a cross-sectional view of the key structure, taken along line C-C in FIG. 1.
Figure 2D:
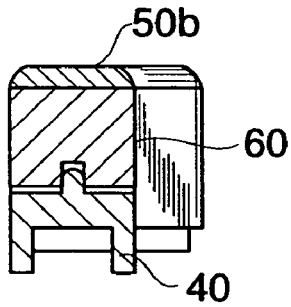
FIG. 2D is a cross-sectional view of the key structure, taken along line D-D in FIG. 1.
Figure 2E:
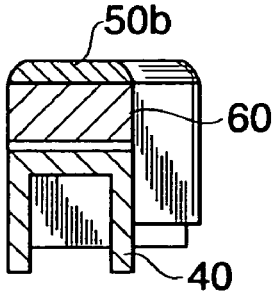
FIG. 2E is a cross-sectional view of the key structure, taken along line E-E in FIG. 1.
Figure 2F:
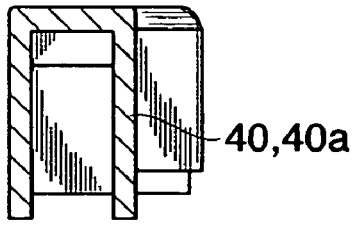
FIG. 2F is a cross-sectional view of the key structure, taken along line F-F in FIG. 1.

The front end of the key structure 100 has an increased width in plan view (compare FIGS. 2A and 2B). That is, as shown in FIG. 4A, an increased width part 60*h* of the wood part 60 having the same width as that of an increased width part 50*h* of an upper part 50*h* of the upper plate 50 is disposed below the increased width part 50*h*. Then, as shown in FIGS. 4A to 4C, the increased width part 60*h* of the wood part 60 at a front end of the key structure 100 is formed with a recess 121 having a shape of a rectangular parallelepiped and opening downward. The recess 121 is formed e.g. by counter boring. Further, a portion of the key base 40 corresponding to the recess 121 is provided with a convex fitting part (lubricant-avoiding mechanism part) 47 which is continuous with the key-guided part 42. More specifically, the key-guided part 42 is formed of a pair of hanging parts hanging down from the front end of the key structure 100 in the direction of key depression, for causing the key structure 100 to be guided when it is pivotally moved about the pivot 41. The convex fitting part 47 continues upward from the pair of hanging parts. Further, the convex fitting part 47 is fitted in the recess 121.

The convex fitting part 47 is, as shown in FIG. 4C, comprised of a horizontal wall 47U and two vertical walls 47A and 47B. The horizontal wall 47U is formed adjacent to an upper end (an end toward the upper surface of the key) of the recess 121 formed by counter boring the wood part 60, such that the horizontal wall 47U closes an upper end of space defined between the vertical walls 47A and 47B, thereby forming a closing wall. The convex fitting part 47 has a recess 47*a* defined therein and having vertical inner surfaces thereof in sliding contact with the key operation guide 75. The convex fitting part 47 also plays the role of "the lubricant-avoiding mechanism part", as will be described hereinafter. The recess 47*a* may be formed as a key guide part.

The configuration of the key-guided part 42 can be described in another way: The key-guided part 42 is mainly composed of left and right inner walls 42*a* of the pair of hanging parts, and a space defined between the left and right walls 42*a* and extending at least from the location of the lower ends of the left and side walls 42*a* to the level of the lower surface 60*d* of the wood part 60. The key-guided part 42 has the two walls 47A and 47B as a pair of extensions from the respective tops of the hanging parts toward the key surface, and a portion of the wood part 60 corresponding to the extensions is formed with the recess 121 by counter boring.

If the key operation guide 75 were formed with a reduced height such that it ends at the same level as the top surface of the key base 40 during key depression, the recess 121 can be dispensed with. Even in this case, an amount of length corresponding to the thickness of the key base 40 in the vertical direction can be secured for part of the vertical length of the key-guided part 42, and therefore the space extending in the key-depressing direction has only to extend from the lower end of the key-guided part 42 to the lower surface 60*d* of the wood part 60. That is, the bottom surface of the recess 47*a* may be flush with the lower surface 60*d* of the wood part 60. Even with this amount of depth of the recess 47*a*, the key depression-guiding function is stabily exhibited compared with the case where the bottom surface of the recess 47*a* is flush with lower surface of the key base 40. In the present embodiment, as described above, the convex fitting part 47 is provided in the recess 121 of the wood part 60, and the key operation guide 75 is slidably inserted in the convex fitting part 47, which makes the key depression-guiding function to be even more stably exhibited.

Further, as can be understood from FIG. 4A, the front part 50*a* of the upper plate 50 corresponds to the front butt end member. The front part 50*a* extends vertically downward along the wood part 60 and the key base 40 to overlap the key base 40. This prevents the juncture between the wood part 60 and the key base 40 from being visible from the front, which improves the appearance of the key. Further, since there is no juncture in the front part 50*a*, there is no catching of the front part 50*a* while the key is guided, which provides stable guiding performance of the key-guided part 42.

Now, as shown in FIGS. 4C and 4D, the width in the direction of juxtaposition of keys is configured as follows: First, the width of the front end of the key structure 100 is equal to that of the increased width part 50*h* of the upper plate 50 and that of the increased width part 60*h* of the wood part 60, and this width is designated by "B0". Further, the width of the recess 121 is designated by "W0", the width of the key operation guide 71 by "B1", the respective widths (thicknesses) of the vertical walls 47A and 47B by "B2" and "B3", and the widths of gaps between the walls 47A and 47B of the convex fitting part 47 and respective opposed walls of the wood part 60 are both designated by "B4". Then, the width W0 of the recess 121 can be defined by the following equation:

$$W0=B1+B2+B3+B4+B4.$$

The width of keys which are employed in pianos in general and called "standard keys" is about 21 to 23 mm, and in the present embodiment, B0 is set to be equal to 22.5 mm. By the way, the key operation guide 75 needs to have a sufficient rigidity so as to positively perform its function, and hence its thickness B1 is set to 5.25 mm. The widths B2 and B3 of the walls 47A and 47B of the convex fitting part 47 are both set to 2.5 mm with a view to ensuring sufficient rigidity thereof. Further, a target dimension of the gap B4 is set to 0.5 mm, so as to allow for variations in dimensions of the recess 121 and the convex fitting part 47.

With these settings, to mount the key operation guide 75 having adequate strength, it is necessary to set at least the width WO of the recess 121 to not less than 11.25 mm. Therefore, in the present embodiment, the width W0 is set to 11.25 mm, that is, set to 50% of the width B0.

Now, the setting of the ratio of the width W0 of the recess 121 to the width B0 of the front end of the key structure 100 to not less than 50% can be similarly applied to keys having different widths, so as to secure sufficient rigidity of the key operation guide. That is, suitable values of thicknesses of the key operation guide and walls of the convex fitting part vary with the width of the key, so that the smallest possible value of the width W0 of the recess 121 necessary for the proper functioning of the key operation guide is not less than 50% of the width B0 of the front end of the key structure 100.

By the way, the functional part to be received in a convex fitting part provided in the wood part 60 can be, besides the key operation guide 75, driving parts, such as the mass member-driving part 43 and the key actuator 44, light-emitting parts, such as LEDs, sensors, such as capacitance elements, detecting parts, such as piezoelectric elements, and so forth. Almost all of these functional parts, configured as separate parts from the key structure 100, have sizes which can be accommodated within the range of the width W0. Therefore, the setting of the ratio of the width W0 to not less than 50% substantially increases the range of types of functional parts which can be mounted.

Some functional parts, such as the mass member-driving part and the key actuator, can be formed integrally with the upper plate 50, for example, in a manner hanging downward from the upper plate 50. In this case, the wood part 60 may be formed therein with a through hole, in place of the recess 121, whereby the functional parts may be allowed to hang downward through the through hole. This makes it possible to use the same settings of the widths and thicknesses described above.

On the other hand, as to the maximum allowable value of the width W0 of the recess 121, it is preferable that in the case of the key structure using the wood part, the maximum allowable value of the width W0 of the recess 121 is determined in view of limitations relating to machinability of the wood part 60 (the large width part 60*h*). More specifically, the width-related machining of the wood part 60 is normally carried out by a cutting tool, such as a rotary tool. However, if the thickness of the side walls of the wood part 60 defining the recess 121 is made too small due to too large a value being set to the width W0 of the recess 121, the machining cannot be performed with ease. For example, when the thickness becomes equal to a value not more than 2 mm, particularly, approximately 1 mm, it may be necessary to apply a reinforcing plate to the related part of the wood part 60 during the width-related machining, or it may be difficult to perform the machining under cutting conditions suitable for wood cutting.

In view of these circumstances, with a view to performing the machining of the wood part 60 and other related parts of the key structure under suitable machining conditions, it is desirable to assign a thickness of at least 2 mm to each of the side walls of the wood part 60 defining the recess 121. By taking this into consideration, for the standard keys, it is desirable to set the maximum allowable value of the width WO of the recess 121 to about 18 mm. Therefore, in terms of ratio, the setting of the width W0 of the recess 121 to not more than 80% of the width B0 of the front end of the key structure 100 can be applied to approximately all key structures with different key widths. In consideration of the freedom of mounting of various functional parts, after all, it is preferable that the percentage of the width W0 to the width B0 is within a range of 50 to 80%.

Further, a thickness of several mm is assigned to a part of the wood part 60 between the upper plate 50 and the horizontal wall 47U of the convex fitting part 47, whereby it is possible to prevent a sink from being formed in the upper surface of the upper plate 50 due to bonding between the upper plate 50 and the wood part 60 and provide the key with a uniform playing or depressing surface. This makes it possible not only to secure an excellent appearance of the key but also to reduce the unusual touch feeling of the key surface during performance.

By the way, the thickness of the key operation guide 75 is B1, which is approximately equal to the width of the recess 47*a* of the convex fitting part 47. Therefore, for smooth sliding contact between the key operation guide 75 and the recess 47*a*, lubricant, not shown, is provided between the key operation guide 75 and the recess 47*a*. The convex fitting part 47 also plays the role of "the lubricant-avoiding mechanism part" that is, providing blockage between the lubricant in the recess 47*a* and the recess 121 in particular, of the wood part 60 to thereby prevent the lubricant from entering the wood part 60. What is more, the lubricant is substantially sealed in between the key operation guide 75 and the recess 47*a*, so that there is almost no evaporation of lubricant. These features contribute to preventing not only discoloration of the wood part 60, but also improper functioning of lubricant due to dispersion and deterioration thereof.

The key structure disclosed in Japanese Utility Model Registration Publication No. 2514485, referred to before, is also configured such that a sway prevention pin is received in a recess formed in the wood part. However, the sway prevention pin is configured such that it slides relative to a hole formed by a plastic cover fitted around the pin, and therefore lubricant is applied to the hole. In this case, lubricant is constantly exposed to the air, and therefore there is a fear that the lubricant is evaporated or deteriorated due to the contact between the lubricant and the air, eventually making the sway prevention pin incapable of functioning properly. Therefore, from the viewpoint of preservation of the lubricating effect of the lubricant for a long time, the configuration of the related components of the key structure according to the present embodiment is advantageous over the conventional key structure.

The convex fitting part 47 functions as the lubricant-avoiding mechanism part, not only for the key operation guide 75. More specifically, if a functional part is in sliding relation to the recess 47*a* within the recess 121 during key-depressing and releasing operation, and lubricant is applied to the functional part, the function of the convex fitting part 47 as the lubricant-avoiding mechanism part is also effective for the functional part.

According to the present embodiment, the wood part 60 adds a woody appearance to the key structure. Further, the width W0 of the recess 121 formed in the increased width part 60*h* is set to not less than 50% and not more than 80% of the width B0 of the front end of the key structure. As a result, it is possible to increase the degree of freedom of mounting at least one functional part formed as a separate part from the key structure, while maintaining good machinability. Further, due to the convex fitting part 47, the wood part 60 is shut off from the lubricant applied to the key operation guide 75, it is possible to maintain the lubricating performance over a long time period.

Next, a description will be given of variations of the first embodiment.

Figure 5:
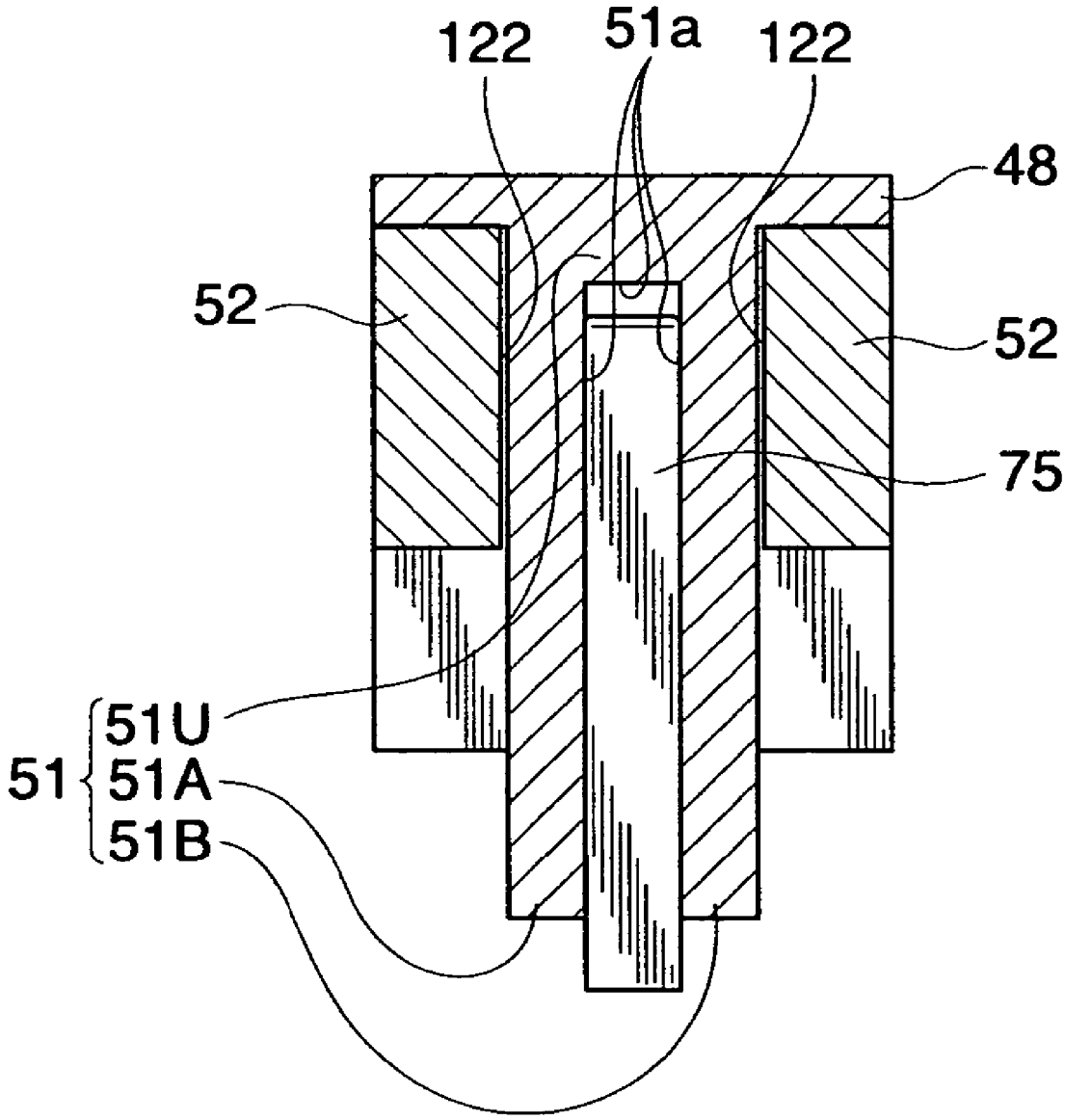
FIG. 5 is a cross-sectional view showing the construction of the front end of a key structure according to a variation I of the first embodiment.

FIG. 5 is a cross-sectional view showing the construction of the front part of a key structure according to a variation I of the present embodiment and corresponds to FIG. 4C.

Although in the example of 4A and 4D, the upper plate 50 and the key base 40 are formed in separate bodies, in the variation I shown in FIG. 5, there is no member corresponding to the key base 40, and a wood part 52 corresponding to the wood part 60 is fixed to the lower surface of an upper plate 48 corresponding to the upper plate 50. A recess 122 corresponding to the recess 121 is formed in the wood part 52. The setting of the width of the recess 122 is similar to that of the recess 121, i.e. the width of the recess 122 is set to a value within a range of 50% to 80% of that of the increased width part of the upper plate 48 and that of the wood part 52. The configuration of the key operation guide 75 is the same as shown in FIG. 4.

Further, in the example of FIGS. 4A to 4D, the convex fitting part 47 as "the lubricant-avoiding mechanism part" is formed integrally with the key base 40. However, in the variation I of FIG. 5, a "lubricant-avoiding mechanism part" 51 corresponding to the convex fitting part 47 is formed integrally with the upper plate 48. More specifically, the lubricant-avoiding mechanism part 51 is comprised of a hanging part base 51U of the upper plate 48, and hanging parts 51A and 51B hanging downward from the hanging part base 51U, and a recess 51*a* having vertical inner surfaces thereof in sliding contact with the key operation guide 75 is formed within the lubricant-avoiding mechanism part 51. The lubricant-avoiding part 51 shuts off lubricant applied to the key operation guide 75 from the wood part 52.

Therefore, also the variation I shown in FIG. 5 can provide the same effects as provided by the example illustrated in FIGS. 4A to 4D.

Figure 6:
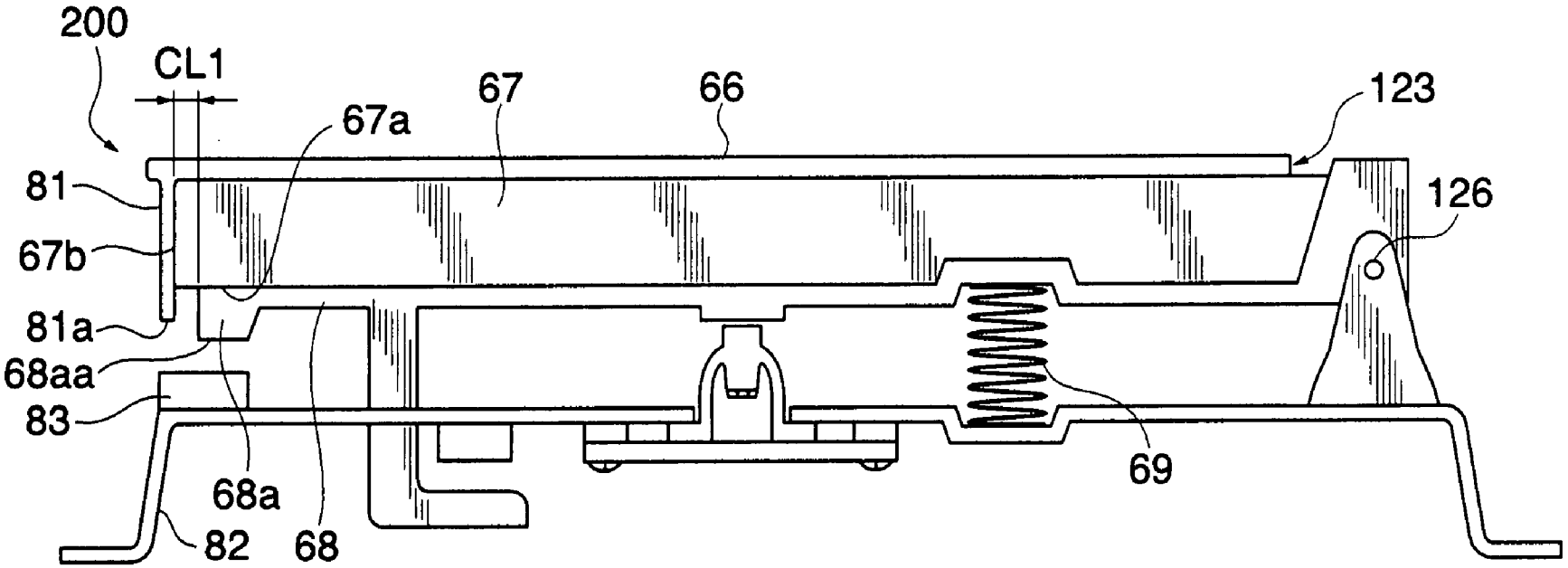
FIG. 6 is a partial cross-sectional view showing the construction of a keyboard apparatus incorporating a key structure according to a second embodiment of the present invention.

Next, a description will be given of a second embodiment of the present invention. FIG. 6 is a cross-sectional view showing the construction of a keyboard apparatus (musical keyboard instrument) including a key structure according to the second embodiment of the present invention The key structure 200 according to the second embodiment is configured as a B key, for example. FIG. 6 is a right side view of the key structure 200. The key structure 200 is applied to a white key, but the construction of the key structure 200 may be applied not only to a white key but also to a black key. In the following description, a side of the present keyboard apparatus and the key structure 200 toward the player will be referred to as "the front side".

The key structure 200 is constructed such that a wood part 67 made of wood is secured to the top of a key base 68 as a holding member, and further an upper plate 123 is secured to the wood part 67. The upper plate 123 is comprised of a front butt end member 81 as a front part, and an upper plate part 66 providing a key operating surface, which are made of a synthetic resin and formed integrally with each other. The front butt end member 81 and the upper plate part 66 may be formed in separate pieces. The wood part 67, which has approximately the same longitudinal length as that of the upper plate part 66, is bonded to the lower surface of 6 the upper plate part 66 with the rear surface of the front butt end member 81 bonded to a front end (player side end) 67*b* thereof.

The key base 68 is made of a synthetic resin as a. one-piece member and has approximately the same longitudinal length as that of the wood part 67. A lower surface as a lower part 67*a* of the wood part 67 is bonded to the top of the key base 68. Further, the key structure 200 is configured such that its front end is vertically movable about a pivot 126 provided at a rear end of the key base 68.

A frame 82 has a key return spring 69 and a key depression limiter 83 provided thereon. The key return spring 69 always urges the key structure 200 upward, thereby returning the key structure 200, which has been depressed, to its original non-depressed position. The key depression limiter 83 is brought into contact with the front end of the key structure 200, thereby limiting the key depression-terminating position of the key structure 200 (the lower limit position where the pivotal movement of the key structure 200 is stopped). The key depression limiter 83 is disposed such that it is brought into contact with a point of the key structure 200 as close as possible to the foremost end thereof, so as to exhibit its pivotal movement-limiting function to the fullest possible extent. More specifically, the key depression limiter 200 is disposed right below both the front end (player side end) 68*a* of the key base 68 and the front butt end member 81.

The front butt end member 81 and the front end 68*a* of the key base 68 define therebetween a gap (having a predetermined clearance) CL1 in the longitudinal direction, whereby the front butt end member 81 and the key base 68 do not interfere with each other even if the wood part 67 expands and contracts or deforms due to changes in environmental conditions, such as temperature and humidity. This prevents the phenomenon of the front butt end member 81 and the key base 68 urging each other. Therefore, it is possible to prevent deterioration of the fixation of the wood part 67 to the front but end member 81 and the key base 68, such as occurrence of separation between these members, due to changes in environmental conditions, whereby desired durability of the key structure 200 can be secured. The gap CL1 is set to a minimum value with the amount of expansion or contraction or deformation of the wood part 67 taken into account.

With the gap CL1 being thus secured, further, by forming the front butt end member 81 in the form of a C shape in plan view (a shape closed on three sides), it is possible to prevent damage to the front butt end member 81 when the key structure 200 is moved, mounted or removed with the front butt end member 81 alone held by hand.

Further, the front end 68*a* of the key base 68 slightly protrudes downward, and a lower surface 68*aa* thereof is located below a lower end 81*a* of the front butt end member 81. As a result, when the key structure 200 is pivotally moved downward, the lower surface 68*aa* of the front end 68*a* of the key base 68 is brought into abutment with the key depression limiter 83, but the lower end 81*a* of the front butt end member 81 is not. This inhibits an upward external force from being applied to the front butt end member 81 when the key depression is terminated, and thereby prevents the deterioration of the fixation of the front butt end member 81 to the wood part 67, to ensure desired durability of the key structure 200. On the other hand, the key depression-terminating position of the key structure 200 is limited by the abutment of the lower surface 68*aa* against the key depression limiter 83. However, since the gap CL1 is set to the minimum value (e.g. approximately 1 mm), the key depression limiter 83 can be brought into abutment with an almost foremost end of the key structure 200, which ensures the pivotal movement-limiting capability of the key depression limiter 83.

Further, the wood part 67 is disposed such that the lower surface 67*a* as the lower part of the wood part 67 is located above the lower end 81*a* of the front butt end member 81. Thus, a part of the wood part 67 upward of the lower end 81*a* of the front but end member 67 does not come into view of the player. Therefore, by thus disposing the wood part 67, it is possible to make effective use of wood forming the wood part 67 by reducing the wasteful use of a wood material therefor while securing the woody appearance. As a result, it is possible to reduce the size and weight of the key structure 200.

According to the present embodiment, it is possible to give a woody appearance to the key, and prevent changes in the environmental conditions from causing deterioration of the fixation of the wood part 67 to the front butt end member 81 and the key base 68, and prevent key depression operations from causing deterioration of the fixation of the front butt end member 81 to the wood part 67, to thereby secure desired durability of the key structure 200. Further, it is possible to reduce the size and weight of the key structure 200 by reducing the wasteful use of a wood material for the wood part 67.

The key depression limiter 83 is not limited to a type which limits the key depression-terminating position of the key structure 200 where the key structure 200 moved by the normal key depression is stopped, but may be a type which sets a limit to the position of the key structure where the pivotal movement of the key structure is stopped e.g. when the key is strongly depressed or when a strong external force other than the force of key depression is applied to the key structure 200 from above.

Next, a description will be given of variations of the second embodiment.

Figure 7A:
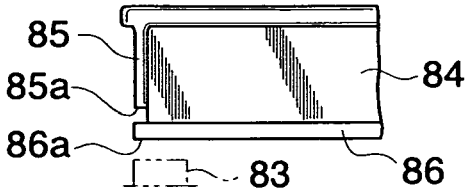
FIG. 7A is a right side view showing the construction of the front end of a key structure according to a variation II-1 of the second embodiment.
Figure 7B:
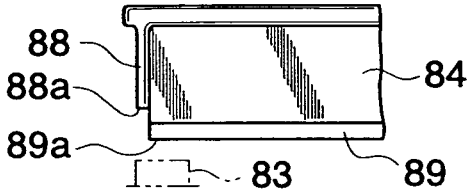
FIG. 7B is a right side view showing the construction of the front end of a key structure according to a variation II-2 of the second embodiment.
Figure 7C:
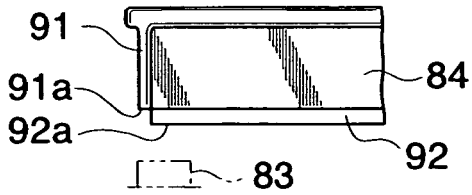
FIG. 7C is a right side view showing the construction of the front end of a key structure according to a variation II-3 of the second embodiment.
Figure 7D:
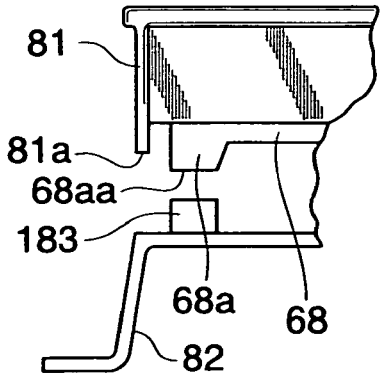
FIG. 7D is a right side view showing the construction of the front end of a key structure according to a variation II-4 of the second embodiment.
Figure 8:
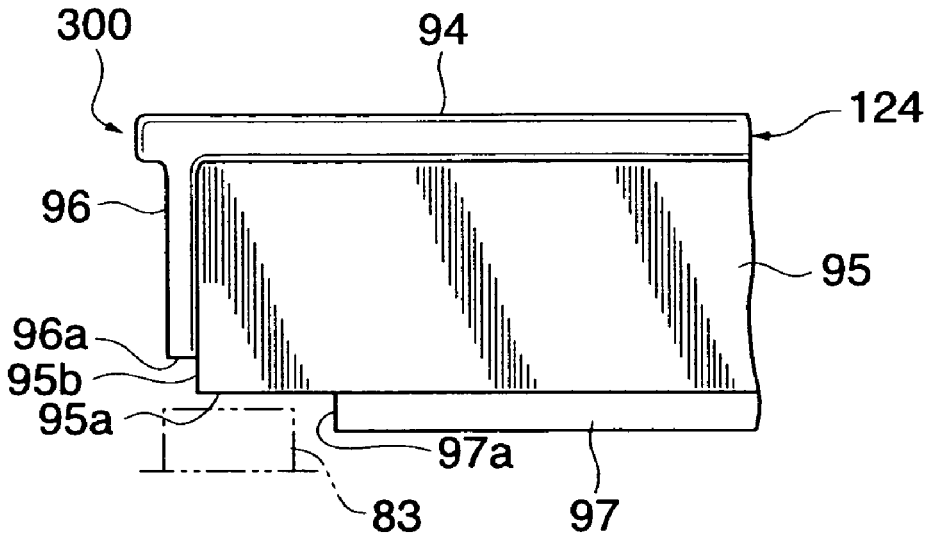
FIG. 8 is a right side view showing the construction of the front end of a key structure according to a variation II-5 of the second embodiment.

In limiting the key depression-terminating position, from the viewpoint of preventing a limiting member, such as the key depression limiter 83, from being brought into abutment with the front butt end member to thereby prevent deterioration of the fixation of the front butt end member to the wood part, the configuration illustrated in FIG. 6 is not limitative, but it is also possible to employ any of configurations of variations II-1 to II-4 shown in FIGS. 7A to 7D, and a variation II-5 shown in FIG. 8.

FIGS. 7A to 7D are right side views of front ends of key structures according to variations II-1, II-2, II-3, and II-4 of the second embodiment. In FIGS. 7A to 7C, the key limiter 83 is identical in configuration and disposition to the example shown in FIG. 6. Components not shown in FIGS. 7A to 7D are the same as those shown in FIG. 6.

In the variation II-1 shown in FIG. 7A, a front butt end member 85 is short, and a lower end 85*a* of the front butt end member 85 is located higher than the lower surface of a wood part 84. A key base 86 does not protrude downward differently from the front end 68*a* of the key base 68, but extends to a location of the lower end 85*a* of the front butt end member 85 in the longitudinal direction. A lower surface 86*a* of a front end of the key base 86 is located lower than the lower end 85*a* of the front butt end member 85.

In the variation II-2 shown in FIG. 7B, a front butt end member 88 is short similarly to the variation II-1, and a key base 89 extends to a location of a front end of the wood part 84 in the longitudinal direction. A lower surface 89 of a front end of the key base 89 is located lower than a lower end 88*a* of the front butt end member 88.

In the variation II-3 shown in FIG. 7C, a front butt end member 91 extends to a lower end of the wood part. A key base 92 extends to a location of a front end of the wood part 84 in the longitudinal direction. A lower surface 92*a* of a front end of the key base 92 is located lower than a lower end 91*a* of the front butt end member 91.

In any of the variations II-1 to II-3, during key depressing operation, the front butt end members 85, 88, and 91 are not brought into abutment with the key depression limiter 83, so that it is possible to prevent deterioration of the fixation of the front butt end members to the wood part 84, which can be caused by repeated depressing operations.

In the variation II-4 shown in FIG. 7D, only the configuration of the key depression limiter is different from that of the example shown in FIG. 6. More specifically, a key depression limiter 183 is disposed directly below the lower surface 68*a* of the key base 68, and the front butt end member 81 is located forward of the front end of the key depression limiter 183. Therefore, when the key structure 200 is pivotally moved downward e.g. due to key depressing operation, similarly to the example shown in FIG. 6, the lower surface 68*aa* of the front end 68*a* of the key base 68 is brought into abutment with the key depression limiter 183, but differently from the FIG. 6 example, even when a very strong force is applied to the key structure 200, e.g. by key depression with a strong force, the key depression limiter 183 is never brought into abutment with the front butt end member 81.

This makes it possible to positively prevent deterioration of the fixation of the front butt end member 81 to the wood part 67, to thereby secure desired durability the key structure 200.

FIG. 8 is a side view of a front end of a key structure according to a variation II-5 of the second embodiment. Components not shown in FIG. 8 are the same as those shown in the example of FIG. 6.

Similarly to the key structure 200 shown in FIG. 6, the key structure 300 according to the present variation II-5 is comprised of a wood part 95 made of wood, a key base 97 having a top to which the wood part 95 is secured, and an upper plate 124 which is composed of a front butt end member 96 and an upper plate part 94, and secured to the wood part 95. The key depression limiter 83 of this variation is identical in configuration and disposition to that shown in FIG. 6.

A front end (player side end) 95*b* of the wood part 95 is located toward the player side with respect to (forward of) the front end (player side end) 97*a* of the key base 97, so that a lower surface 95*a* of a front end of the wood part 95 is exposed. Further, the lower surface 95*a* of the front end of the wood part 95 is located lower than a lower end 96*a* of a front butt end member 96 of an upper plate 124. With this configuration, the key depression-terminating position of the key structure 300 during key depression is determined by abutment of the exposed lower end 95*a* of the front end of the wood part 95 with the key depression limiter 83, and abutment of the front butt end member 96 with the key depression limiter 83 is avoided, which prevents deterioration of the fixation of the front butt end member 96 to the wood part 95, which can be caused by repeated key depressing operations.

These variations provide the same advantageous effects as provided by the example of the configuration shown in FIG. 6 in that while securing a proper pivotal movement-limiting function, the deterioration of the fixation of the front butt end member to the woody part is avoided to improve durability of the key structure. Particularly, in the variations II-1, II-2, and II-5, the front butt end members 85, 88, and 96, and the respective key bases 86, 89, and 97 are inhibited from being brought into abutment with each other, to thereby provide the same advantageous effects of prevention of the deterioration of the fixation of the associated members due to changes in the environmental conditions.

Although in the first and second embodiments and the variations thereof, configurations have been proposed to prevent the fixation of the front butt end member 81, the wood part 67 and the key base 68, the present invention is not limited to these configurations. For example, the present invention is also applicable to the case where the front butt end member 81 is not fixed to the wood part 67 or the key base 68, and at the same time the upper plate part 66 and the wood part 67 are secured to each other e.g. by an adhesive, making it possible to prevent deterioration of the fixation of the upper plate part 66 and the wood part 67, which can be caused by changes in the environmental conditions and key depressing operation, whereby the front end of the key structure 200 can be prevented from becoming faulty, to thereby secure desired durability the key structure 200.

Figure 9:
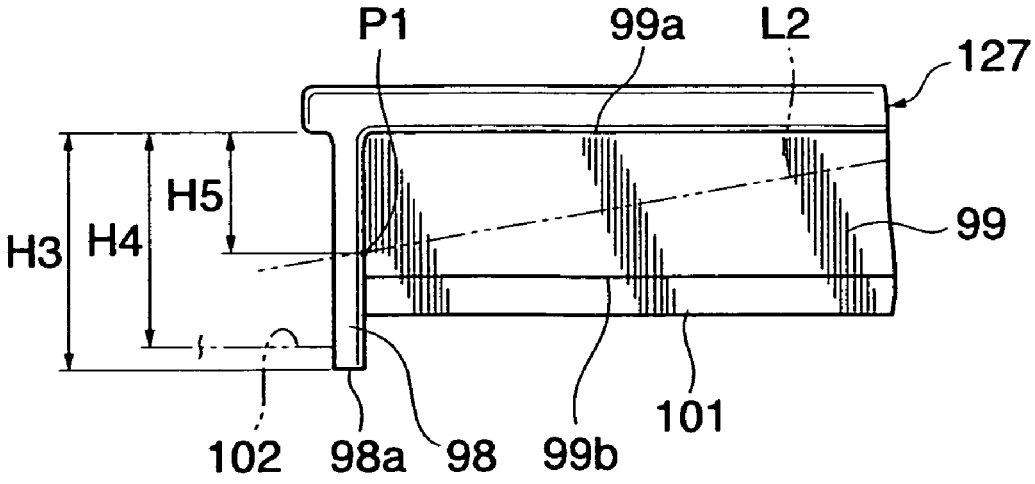
FIG. 9 is a right side view showing the construction of the front end of a key structure according to a variation II-6 of the second embodiment.

To reduce the wasteful use of a wood material for the wood part and hence reduce the size and weight of the key structure, the manner of disposition of the wood part is not limited to that shown in FIG. 6, but may be that of a variation II-6 shown in FIG. 9.

FIG. 9 is a right side view of a front end of a key structure according to the variation II-6 of the second embodiment. The key structure of the variation II-6 is comprised of a wood part 99 made of wood, and a key base 101 having a top to which the wood part 99 is secured, and an upper plate 127 fixed to the wood part 99. In the variation II-6, the wood part 99 is disposed such that a lower surface 99*b* as the lowest portion of the wood part 99 is located higher than a lower end 98*a* of a front butt end member 98. In this respect, this variation II-6 is the same as shown in FIG. 6.

When an adjacent white key as the key structure is depressed and the adjacent key is in a key depression-terminating position, the position of the key depressing surface of the adjacent key (hereinafter referred to as the "adjacent key depressing surface position") is designated by "L2". In side view, the intersection of the adjacent key depressing surface position L2 of the depressed key and the front end of the wood part 99 is designated by "P1". The distance between an upper surface 99*a* of the wood part 99 and the lower end 98*a* of the front butt end member 98 is designated by "H3", the distance between the upper surface 99*a* and a keyslip top surface 102 by "H4, and the distance between the upper surface 99*a* and the intersection P1 by "H5".

In a piano in general, the lowest part of the front butt end member is hidden from view by the keyslip, and therefore the relationship of H3>H4 normally holds. Further, in a general piano, the front end of the adjacent key does not become lower than the keyslip during key depression, and therefore the relationship of H4>H5 holds. Moreover, in a side of the key structure, a part of the key lower than the adjacent key depressing surface position L2 cannot be seen during performance, and therefore, to give a woody appearance to the key due to the presence of the wood part 99, it suffices for the wood part 99 to be disposed in an area at the same level as or above the adjacent key depressing surface position L2 when the key is not depressed.

In view of these points, assuming that the lower surface 99*b* as the lower end of the wood part 99 is horizontal when the key is not depressed, it is preferable that the lower surface 99*b* is located as high as possible insofar as the lower surface 99*b* is not higher than the intersection P1. Therefore, as shown in FIG. 9, the wood part 99 is disposed such that the lower surface 99*b* is located slightly lower than the intersection P1.

According to the variation II-6, it is possible to give a woody appearance to the key, and more efficiently reduce the wasteful use of a wood material for the wood part to reduce the size and weight of the key structure to the most possible extent.

As a further variation of the variation II-6, the wood part 99 may be configured such that the lower surface 99*b* extends below and substantially parallel to the adjacent key depressing surface position L2 when the key is not depressed, as described later.

Only from the viewpoint of the reduction of wasteful use of a wood material for the wood part, the upper plate 127 alone suffices as a holding member that fixedly holds the wood part 99, and the key base 101 need not be provided as the holding member.

Figure 10:
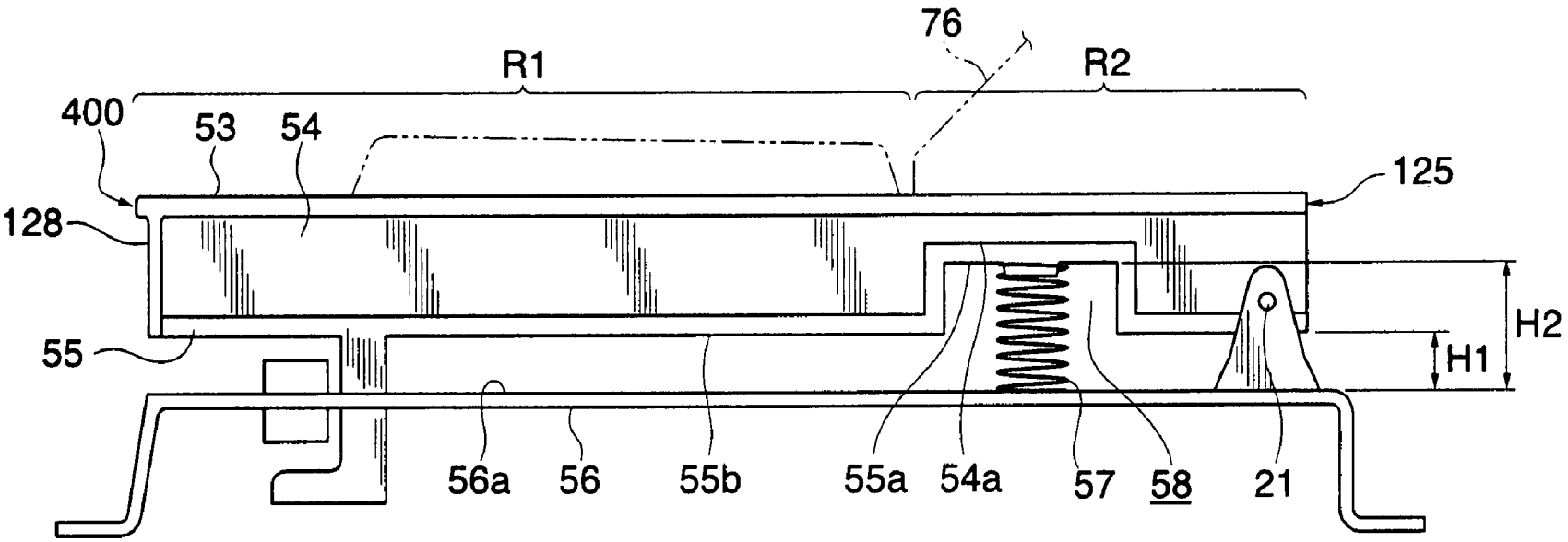
FIG. 10 is a partial cross-sectional view showing the construction of a keyboard apparatus incorporating a key structure according to a third embodiment of the present invention.

Next, a description will be given of a third embodiment of the present invention. FIG. 10 is a cross-sectional view showing the construction of a keyboard apparatus including a key structure according to the third embodiment of the present invention. The key structure 400 according to the third embodiment is configured as a B key, for example. FIG. 10 is a right side view of the key structure 400. The key structure 400 is applied to a white key, but the construction of the key structure 400 may be also applied to a black key. In the following description, a side of the present keyboard apparatus and the key structure 400 toward the player will be referred to as "the front side".

The key structure 400 is constructed such that a wood part 54 made of wood is secured to the top of a key base 55 as the holding member, and further an upper plate 125 as the holding member is secured to the wood part 54. The upper plate 125 is comprised of a front butt end member 128 as a front part (the end toward the player), and an upper plate part 53 providing a key depressing surface, which are made of a synthetic resin and formed integrally with each other. The upper plate 125 and the key base 55 form the "holding member" that holds the wood part 54. The front butt end member 128 and the upper plate part 53 may be formed in separate pieces. The wood part 54, which has approximately the same longitudinal length as that of the upper plate part 53, is bonded to the lower surface of the upper plate part 53 and the rear surface of the front butt end member 128.

The key base 55 is made of a synthetic resin and has approximately the same longitudinal length as that of the wood part 54. A lower surface of the wood part 54 is bonded to the top of the key base 55. Further, the key structure 400 is configured such that its front end is vertically movable about a pivot 21 provided at a rear end of the wood part 54.

A panel part 76 is provided above the key structure 400. The panel part 76 is equipped with various operating elements and a display section, not shown, and also serves as a hiding part that hides a part of the key structure rearward thereof. Therefore, between the player side end and the pivot 21, a part of the key structure 400 forward of the panel part 76 is visible as a "visible part R1" from the outside during both performance and non-performance, and the part rearward of the panel part 76 is a "non-visible part R2".

A key return spring 57 as a functional part and the like are provided on an upper surface 56*a* of a frame 56. The key return spring 57 always urges the key structure 400 upward, thereby returning the key structure 400, which has been depressed, to its original non-depressed position. The key return spring 57 is received in a recess 58 provided in a rear end of the key structure 400. The key return spring 57 is received in a recess 58 provided at a rear end of the key structure 400.

More specifically, in the non-visible part R2", a part of the wood part 54 corresponding to the rear end of the key structure 400 is formed therein with a recess 54*a*, and the key base 55 is also formed therein with a recess 55*a* extending along the recess 54*a*, whereby the recess 58 is formed. The key return spring 57 is interposed between the bottom of the recess 55*a* and the upper surface 56*a* of the frame 56. It is assumed here that the key return spring 57 is in a proper state when it has a length of approximately H2 under predetermined conditions (e.g. during key depression). In the example illustrated in FIG. 10, the distance between the bottom of the recess 55*a* and the upper surface 56*a* of the frame 56 is equal to H2, and therefore the key return spring 57 is properly mounted.

However, if the recess 58 were not provided and the lower surface of the key base 55 were flush over its entire length, the distance over which the key return spring 57 extends is H1, that is, the space for mounting the spring 57 is insufficient. Therefore, it is necessary to design the keyboard apparatus such that a part of the key structure 400 is raised upward or spaced at an increased distance from the frame 56, so as to secure the distance H2.

In the present embodiment, as shown in FIG. 10, with the provision of the recess 58, the distance between the frame 56 and the key structure 400 can be set short even when the key return spring 57 is mounted. This saves space in the vertical direction. Further, the wasteful use of a wood material for the wood part 54 can be reduced by the recess amount of the recess 58 to thereby reduce the weight of the keyboard apparatus. What is more, the recess 58 is provided in the non-visible part R2, whereby an excellent woody appearance of the key is secured.

The present invention is not limited to the construction that the key return spring 57 is accommodated in the recess 58. In addition, one or more functional parts for realizing the key operation, examples of which include a key switch actuator, a mass member-driving section, a key fall-off prevention member, as well as an S-shaped spring having an S shape in side view for urging the key and a hammer toward respective pivots, further, a sensor section, a detector section, etc., may be accommodated in one or more similar recesses. Particularly, when a functional part long in the longitudinal direction, such as the S-shaped spring, is mounted, there are less limitations related to the space in the vertical direction, which also leads to saving of space in the longitudinal direction.

According to the present embodiment, it is possible to reduce the size and weight of the keyboard apparatus, while giving a woody appearance to the key.

Although in the third embodiment, there is illustrated an example in which the holding member that fixedly holds the wood part is formed by the upper plate 125 and the key base 55 as separate bodies, this is not limitative, but the present invention is applicable to a configuration in which the wood part is held by the upper plate alone, or the wood part is held by a holding member comprised of an upper plate and a key base formed integrally with each other.

Figure 11:
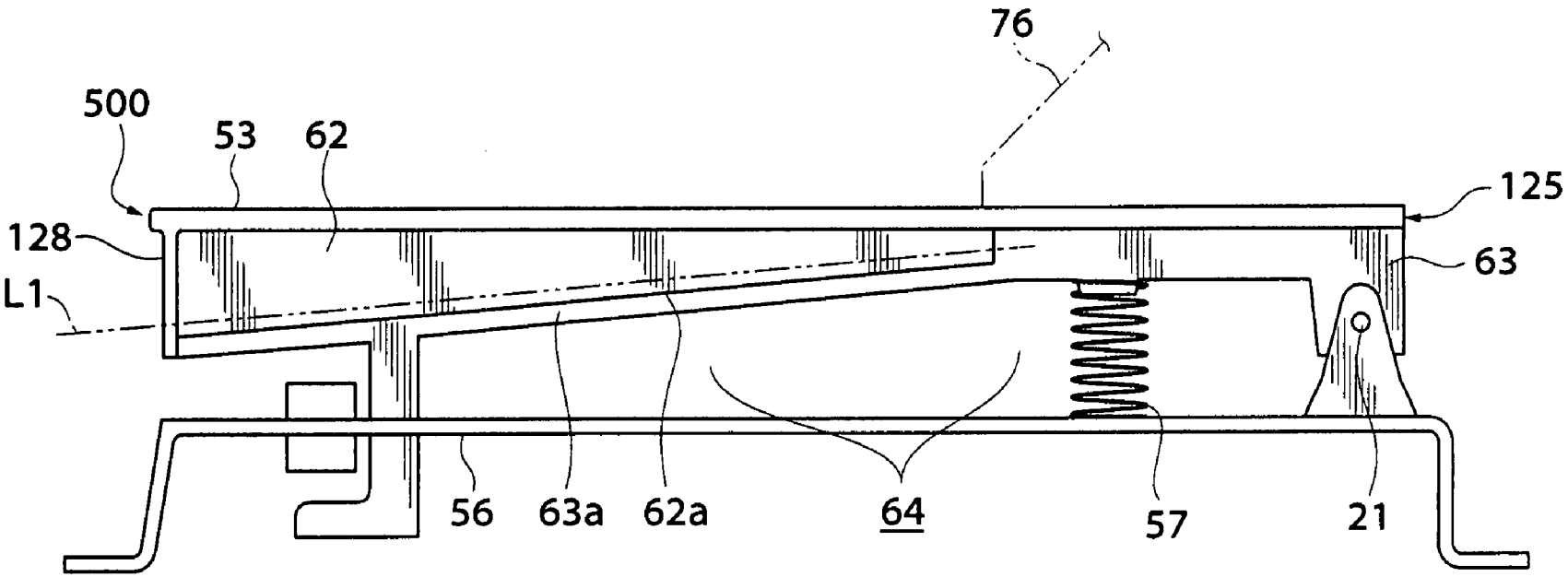
FIG. 11 is a partial cross-sectional view showing the construction of a keyboard apparatus incorporating a key structure according to a fourth embodiment of the present invention.

FIG. 11 is a partial cross-sectional view of a keyboard apparatus incorporating a key structure according to a fourth embodiment of the present invention. The fourth embodiment is distinguished from the third embodiment in the shape of the recess in the key structure, and hence in the shapes of the wood part and the key base. The two embodiments are identical in construction in the other respects.

As shown in FIG. 11, the key structure 500 according to the fourth embodiment is comprised of a key base 63 as the holding member, a wood part 62 secured to the top of the key base 63, and an upper plate 125 secured to the wood part 62. The respective configurations of the upper plate 125, a frame 56, a key return spring 57, and a panel part 76 are the same as those of the third embodiment. The upper plate 125 and the key base 63 form the "holding member" that holds the wood part 62.

In FIG. 11, the symbol "L1" designates an adjacent key depressing surface position of an adjacent white key as the key structure which is depressed to a key depression-terminating position. A lower surface 62*a* of the wood part 62 forward of the panel part 76 is sloped upward from the front end to the rear end. The lower surface 62*a* is located below the adjacent key depressing surface position L1 over its entire range in the longitudinal direction, and extends substantially parallel thereto when the key is not depressed. This makes it possible to secure a woody appearance and at the same time efficiently eliminate the wasteful use of a wood material for the wood part 62. Further, an inclined part 63*a* of the key base 63 is bonded to the lower surface 62*a* of the wood part 62, and inclined at the same angle as the adjacent key depressing surface position L1.

This forms a recess 64 as a large space between the key structure 500 and the frame 56 in a region from the inclined part 63*a* of the key base 63 to the rear part of the key structure 500. A part of the key downward and rearward of the adjacent key depressing surface position L1 is a non-visible part, and the recess 64 is formed in this non-visible part, and therefore the appearance of the key is not adversely affected and an excellent woody appearance is ensured.

Similarly to the third embodiment, the key return spring 57 is mounted in the recess 64. At a location where the key return spring 58 is fixed, the vertical length (height) of the recess 64 is equal to that of the recess 58, and therefore, similarly to the third embodiment, space saving is attained in the vertical direction. Further, the recess 64 is larger than the recess 58 (see FIG. 10), which further reduces the wasteful use of a wood material for the wood part 62.

The recess 64 can occupy a sufficiently large area and a sufficient height, and therefore it is possible to dispose therein a key-depression/release-detecting sensor (a key switch, or a full stroke sensor that detects the position of the key assumed during key depression from a time point immediately after the key is depressed by a finger to a time point the key is released from the finger).

The present embodiment provides not only the same advantageous effects as those provided by the third embodiment, that is, giving a woody appearance to the key and reduction of the size and weight of the keyboard apparatus, but also secures an excellent woody appearance with the minimum use of a wood material for the wood part to efficiently save the material for the wood part.

Similarly to the third embodiment, the functional part received in the recess 64 is not limited to the key return spring 57.

In the first to fourth embodiments described above, insofar as the giving of the woody appearance to a key is concerned, the wood part need not be formed of wood, but it may be formed of a woody material. For example, a woodgrain decorative panel (including a printed panel, a coated panel, a painted panel, and sliced veneer), plywood, a medium density fiberboard (MDF), or the like may be employed.

What is claimed is:

1. A key structure that is mountable in a keyboard apparatus, for functioning as a white key pivotally moved by key-depressing operation, comprising:

an upper plate member having an increased width part corresponding to an end of the white key toward a player, said increased width part having a lower surface; and a wood part secured to said lower surface of at least said increased width part of said upper plate member, said wood part having an increased width part having a substantially same width as said increased width part of said upper plate member, wherein:

said wood part has a recess formed in a part thereof including said increased width part, the recess opens downward and having a width which is not less than 50% and not more than 80% of a width of said increased width part of said wood part, and a convex fitting part is fitted in the recess, a pair of hanging parts is provided such that the pair of hanging parts is continuous with the convex fitting part, and a key operation guide slides within inner portions of the convex fitting part and the pair of hanging parts in a key-depressing operation.

2. A keyboard apparatus comprising:

a plurality of keys, at least one of said plurality of keys being formed by a key structure as claimed in claim 1.

3. A key structure that is mountable in a keyboard apparatus, for functioning as a key pivotally moved by key-depressing operation, comprising:

an upper plate member having a lower surface;

a wood part secured to said lower surface of said upper plate member;

said wood part having a recess formed therein and opening downward, the recess receiving at least one functional part for sliding movement relative to the key structure via a lubricant during key-depressing operation; and a lubricant-avoiding mechanism part provided in the recess, for providing blockage between the lubricant and said wood part, wherein, said lubricant-avoiding mechanism part is comprised of a convex fitting part fitted in the recess, the at least one functional part is comprised of a key operation guide, and the key operation guide slides within an inner portion of the convex fitting part.

4. A keyboard apparatus comprising:

a plurality of keys, at least one said plurality of keys being formed by a key structure as claimed in claim 2.

5. A key structure that has a pivot, and an end toward a player, and is mountable in a keyboard apparatus such that said end thereof toward the player is pivotally moved about the pivot by key-depressing operation to thereby function as a key, comprising:

an elongated key base having an upper part, and a free end;

a wood part secured to said upper part of said key base, said wood part having an upper part, and a lower surface;

an upper plate member fixedly held by said upper part of said wood part; and a guided part operable when the end toward the player is pivotally moved about the pivot, to cause the end toward the player to be guided thereby, wherein:

said guided part has a pair of hanging parts hanging downward from said free end of said key base in a key-depressing direction;

said pair of hanging parts have respective lower ends, and left and right inner walls; and said guided part is formed by said left and right inner walls of said pair of hanging parts, and a space defined between said left and right walls and extending at least from a location of said lower ends of said hanging parts to a location of said lower surface of said wood part, wherein a key operation guide is inserted in the space such that the key operation guide slides within said guided part.

6. A key structure as claimed in claim 5, further comprising a front butt end member made of resin and extending along said wood part from said upper plate member to a location where said front butt end member overlaps said key base in front view, said front butt end member abutting on said guided part.

7. A key structure as claimed in claim 5, wherein said pair of hanging parts have respective upper parts, the key structure further comprising a pair of extended parts extending from said respective upper parts toward a surface of the key, and wherein said wood part has a recess formed by counter boring in a part thereof corresponding to said pair of extended parts.

8. A key structure as claimed in claim 7, wherein said pair of extended parts have respective ends toward the surface of the key, and wherein said guided part has a closing part closing a space defined between said ends of said pair of extended parts.

9. A keyboard apparatus comprising:

a plurality of keys, at least one of said plurality of keys being formed by a key structure as claimed in claim 5.

* * * * *